US006066236A

United States Patent [19]

Gilroy

[11] Patent Number: 6,066,236

[45] Date of Patent: May 23, 2000

[54] COKE OVEN WALL WITH A PLURALITY OF FLUE CAVITIES

[75] Inventor: David John Gilroy, Kilaben Bay, Australia

[73] Assignee: BHP Refractories Pty. Ltd., Australia

[21] Appl. No.: 09/000,437

[22] PCT Filed: Aug. 1, 1996

[86] PCT No.: PCT/AU96/00484

§ 371 Date: May 11, 1998

§ 102(e) Date: May 11, 1998

[87] PCT Pub. No.: WO97/05215

PCT Pub. Date: Feb. 13, 1997

[30] Foreign Application Priority Data

Aug. 1, 1995 [AU] Australia ..... 4557/95
Apr. 19, 1996 [AU] Australia ..... 9364/96

[51] Int. Cl.[7] ..... C10B 1/06; C10B 1/00; F23M 5/00; F23M 5/02

[52] U.S. Cl. ..... 202/138; 202/220; 202/223; 110/336; 110/338

[58] Field of Search ..... 202/138, 220, 202/223, 108, 267.1, 124–126, 139, 145; 432/247; 52/566, 568, 379, 412, 415; D25/113, 115, 118; D21/471, 484; 110/336, 338, 331, 332

[56] References Cited

U.S. PATENT DOCUMENTS

| | | | |
|---|---|---|---|
| 1,782,638 | 11/1930 | Totzek | 52/566 |
| 2,141,035 | 12/1938 | Daniels | 202/223 |
| 3,359,184 | 12/1967 | Thiersch et al. | 202/223 |
| 3,809,620 | 5/1974 | Wackerbarth et al. | 202/139 |
| 4,196,052 | 4/1980 | Szurman et al. | 202/138 |
| 4,347,106 | 8/1982 | Wackerbarth | 202/141 |
| 4,364,798 | 12/1982 | Costa | 202/267.1 |
| 4,452,749 | 6/1984 | Kolvek et al. | 264/30 |

FOREIGN PATENT DOCUMENTS

| | | |
|---|---|---|
| 880225 | 3/1943 | France . |
| 1162290 | 9/1958 | France . |
| 1204761 | 1/1960 | France . |
| 676562 | 6/1939 | Germany . |
| 2019078 | 11/1971 | Germany . |
| 2430053 | 6/1974 | Germany . |
| 42 44 547 A1 | 7/1994 | Germany . |
| 57-30784A2 | 2/1982 | Japan . |
| WO 94/16031 | 7/1994 | WIPO . |

*Primary Examiner*—Marian C. Knode
*Assistant Examiner*—Alexa Doroshenk
*Attorney, Agent, or Firm*—Harness, Dickey & Pierce, P.L.C.

[57] ABSTRACT

A coke oven wall (4) comprising a plurality of bricks (38, 42, 46, 120) laid so as to define first and second wall faces (40, 44), and plurality of flue cavities (14) extending therein characterized in that at least part of the wall is made first, second and third bricks (38, 42, 120) which are laid together and define in part the first and second faces and the flue cavities wherein the first brick comprises a first body portion (48) and an inwardly projecting first leg (50), the second brick comprises a second body portion (64) and an inwardly projecting second leg (66) the third brick comprises a flue wall brick (46, 120) which is located between and aligned with the first and second legs.

Also disclosed is a coke oven wall (4) comprising a plurality of bricks (38, 42, 46, 120) which are laid to define flue cavities (14) in the wall, said oven wall including burners (16, 18) in the flue cavities, said burners comprising a stack of burner bricks (86), said burner bricks including interlocking formation which interlock with complementary formations on the bricks which define the flue cavities whereby the burners are supported or restrained in the cavities.

21 Claims, 38 Drawing Sheets

COKE OVEN WALL WITH A PLURALITY OF FLUE CAVITIES

BACKGROUND OF THE INVENTION

This invention relates to a coke oven.

More particularly, the invention relates to novel coke oven wall structures and methods for making coke oven walls.

Coke ovens traditionally comprise massive refractory brick structures in which there are batteries of adjacent parallel walls made up from a large variety of differently shaped refractory bricks. The bricks must be able to withstand high temperatures and strong mechanical loading. At the same time, the interior of the walls contains flue ducts, burners, flue gas control passages and the like. The detailed design of the oven is usually quite complicated in order to obtain the necessary heat distribution within the oven and gas flows through the walls.

It follows from the above that coke ovens are relatively costly structures and any downtime for servicing and repairs can represent a significant economic loss for an operator.

Further, the production of ceramic bricks from which the walls are made is relatively costly and there is accordingly a need to generally reduce the number of different types of bricks which are used in a wall. It is undesirable, however, to have a design concept which utilises relatively large ceramic bricks in the construction. Excessively large bricks cannot be handled without the use of mechanical lifting devices. Further, bricks having a dimension greater than 650 mm machined pressed to form a fused silica product are generally unavailable. Bricks greater than this size can be hand cast but these are much more expensive. Large bricks can be machine pressed from conventional silica, but conventional silica bricks would have a very serious disadvantage in that a wall made therefrom would need a heat up time which is many times greater than that for fused silica bricks.

The object of the invention is to provide a new coke oven wall construction which overcomes a number of disadvantages of the prior art.

BRIEF SUMMARY OF THE INVENTION

According to the present invention there is provided a coke oven wall comprising a plurality of bricks laid so as to define first and second wall faces, and a plurality of flue cavities extending therein characterised in that at least part of the wall is made first, second and third bricks which are laid together and define in part the first and second faces and said flue cavities wherein the fist brick comprises a first body portion and an inwardly projecting first leg the second brick comprises a second body portion and an inwardly projecting second leg the third brick comprises a flue wall brick which is located between and aligned with the first and second legs.

Preferably, one end of the flue brick includes a first interlocking formation and the end of the second leg includes a second, complementary formation.

Preferably further, the other end of the flue wall brick is shaped so that it can be trimmed to length so as to abut the end of the first leg whereby the walls taper depending on the amount trimmed from the other ends of the flue bricks.

Preferably, the first and second bricks include upper and lower formations on upper and lower faces thereof whereby successive courses of bricks interlock with one another. Preferably the upper and lower formations are shaped so that they can be used in an existing expanded battery.

Preferably further, the first and second body portions have the same length and the first leg is offset by a predetermined amount relative to the length of the first body portion and the second leg is offset by the same predetermined amount relative to the length of the second body portion but in the opposite direction, the arrangement being such that the first face of the wall has alternate courses of first and second bricks whereby a bond pattern is formed.

Preferably further, the flue brick includes a third interlocking formation on its upper face and a fourth generally complementary formation on its lower face, said third and fourth formations having a relatively loose fit when said flue bricks are laid on top of each other to thereby accommodate said trimming.

Preferably further, the third and fourth formations do not extend to the edges of the upper and lower faces.

The invention also provides a coke oven wall comprising a plurality of bricks which are laid to define flue cavities in the wall, said oven wall including burners in the flue cavities, said burners comprising a stack of burner bricks said burner bricks including interlocking formations which interlock with complementary formations on the bricks which define the flue cavities whereby the burners are supported or restrained in the cavities.

The present invention also provides a refractory brick having an outer face, an upper face and a lower face, there being provided on the upper face a first interlocking formation which does not extend to the side edges of the upper face of the brick, the lower face of the brick including a second interlocking formation which does not extend to the side edges of the lower face of the brick, the arrangement being such that when the bricks are laid the interlocking formations interlock and wherein one of the first and second formations is of greater width (as measured in the direction towards said outer face) whereby the outer faces of the bricks can define two generally parallel walls of the coke oven which taper and wherein the wider formation accommodates different positions of the narrower formation.

Preferably, the bricks which are laid to define the flue cavities comprise said first, second and third bricks defined above.

Preferably further, side faces of the flue bricks include the formations which interlock with the interlocking formations on the burner bricks.

The invention also includes in combination, first, second, third and burner bricks as defined above.

The invention also provides a coke oven wall having a novel horizontal flue or hairpin therein. In this arrangement, the course or courses of bricks immediately beneath the horizontal flue or hairpin include flue ports which are supported by bridging bricks which extend between faces of the walls above the flue cavities therein.

Preferably, the flue ports are made from a pair of similar interlocking shells.

Preferably further, blocking bricks are located laterally of the flue ports.

Preferably further, the horizontal flue or hairpin includes cover tiles which are laid over said blocking bricks so as to minimise flow of flue gases between gaps therein.

According to a further aspect of the present invention there is provided a method for building a wall for an oven, said method comprising forming the wall using a plurality of modules, said modules being arranged so that adjacent modules of the wall can be interlocked, and placing mortar between adjacent modules to provide a seal therebetween.

An embodiment of the method of a further aspect is advantageous because it enables use of less than 10% of the number of module shapes used in prior art oven wall constructions.

According to a further aspect of the present invention there is provided a method of adjusting the spacing between first and second side walls of an oven wall, said method comprising building said oven wall using a plurality of modules, said plurality of modules comprising at least a plurality of first modules arranged to extend in a direction across the width of the oven wall and to be located substantially between a plurality of second and third modules, said plurality of second modules forming a portion of said first side wall of said oven wall and said plurality of third modules forming a portion of said second side wall of said oven wall, and wherein the spacing between said first and second side walls of said oven wall can be varied along the length thereof by trimming the first modules in length without loss of interlocking.

An oven made in accordance with an embodiment of the further aspect of the invention is advantageous because it maintains the thermodynamic aspects of the oven's design while enabling the oven wall to be built faster and more cost effectively than prior art walls.

According to a further aspect of the present invention there is provided a battery comprising a plurality of ovens, each oven being defined by oven walls made in accordance with the further aspect of the present invention.

BRIEF DESCRIPTION OF THE DRAWINGS

The invention will now be further described with reference to the accompanying drawings, in which.

DETAILED DESCRIPTION OF THE INVENTION

Figure 1:
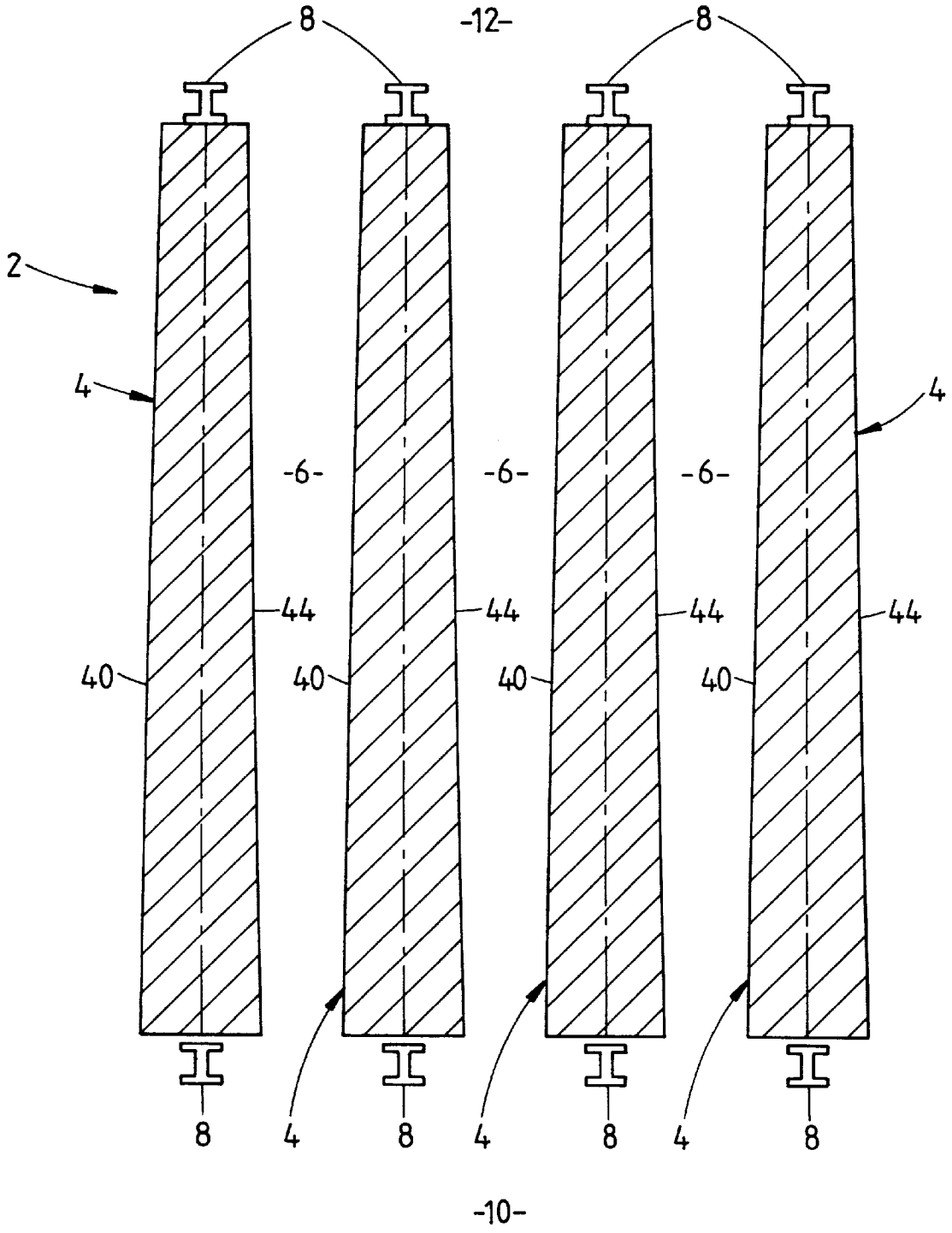
FIG. 1 is a schematic plan of a coke oven battery.

FIG. 1 is a diagrammatic representation of a coke oven battery 2 comprising four coke oven walls 4 defining therebetween three coke ovens 6. The battery may comprise a typical horizontal flue battery (Wilputte) or a typical twin flue battery (Otto Simon Carves) or the like. FIG. 1 shows the ends of the walls 4 being braced by buckstays 8, in the usual way. The adjacent faces of the walls 4 taper slightly from a pusher side 10 to a coke side 12 in the usual way. Usually the taper is typically in the range: 70 mm taper/17 meter wall to 76 mm taper/13–15 meter wall.

Figure 2:
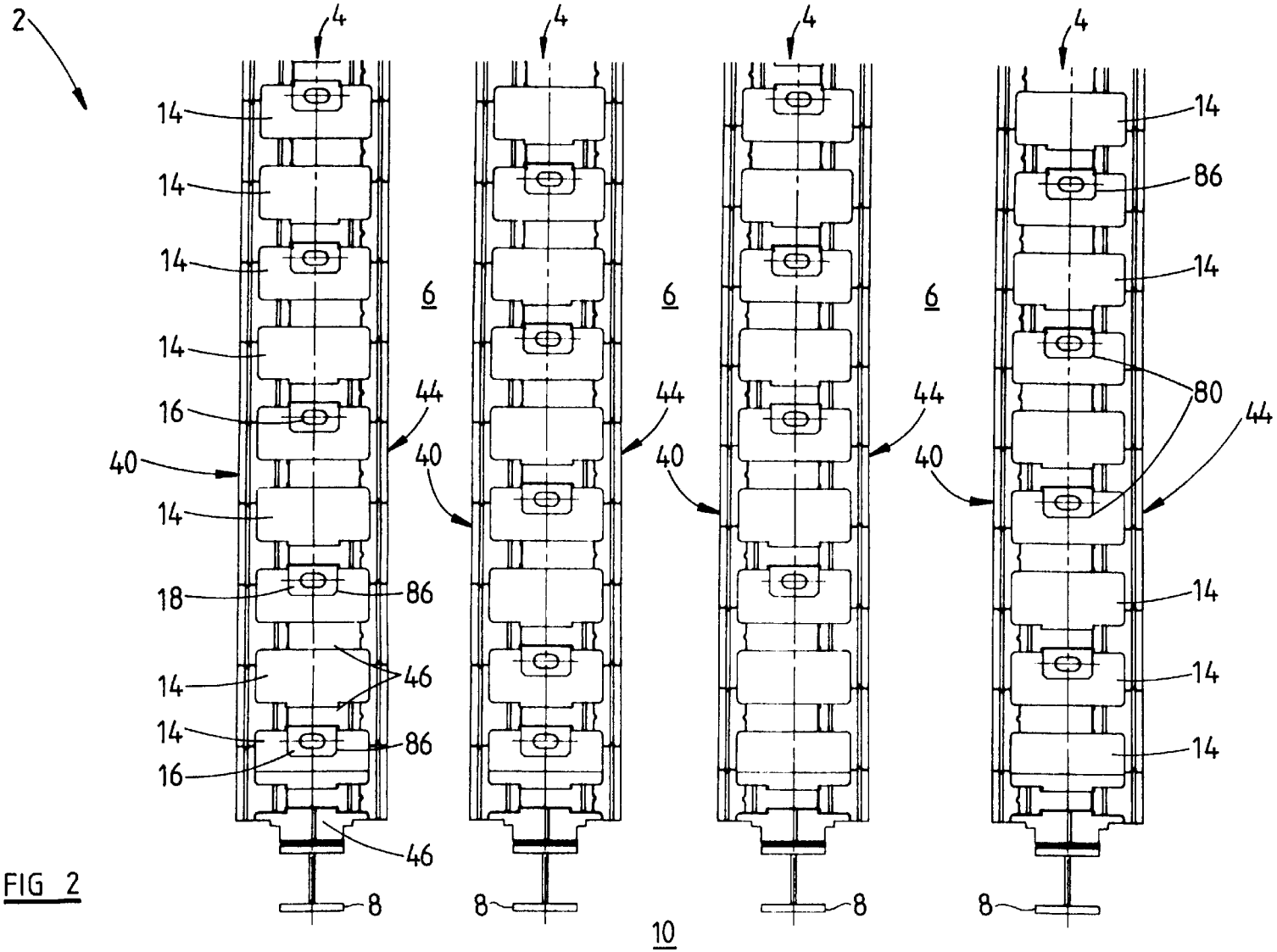
FIG. 2 shows a more detailed plan view of the coke oven battery.
Figure 3:
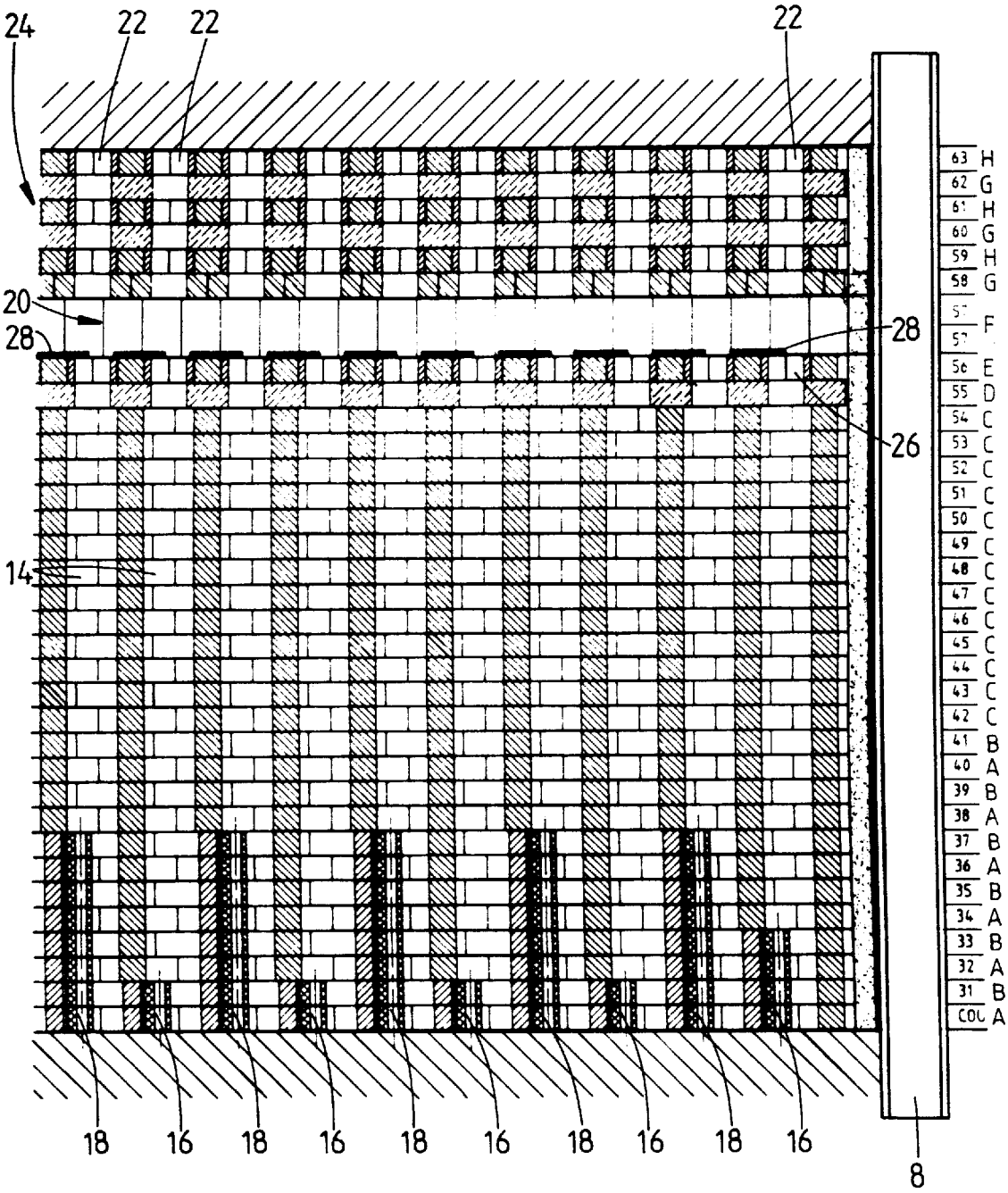
FIG. 3 is a schematic vertical section through one of the oven walls.
Figure 40:
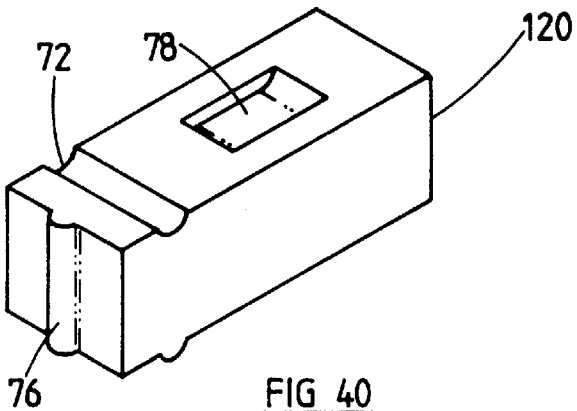
FIG. 40 shows an isometric view of a flue wall brick.
Figure 60:
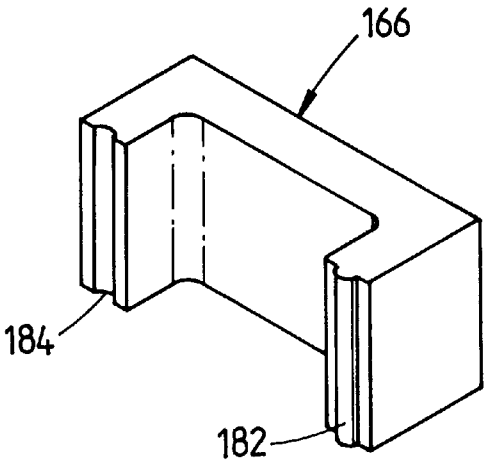
FIG. 60 is a perspective view of a flue port sleeve (half segment)

FIG. 2 illustrates in more detail some of the courses of brick work of the battery 2 of the invention. Generally speaking, all of the walls 4 are of the same construction and therefore only one need be described. The wall is made from a number of different refractory bricks which are interlocked and mortared together, as will be described below. In accordance with the invention, the walls are made from a limited number of machine pressed fused silica bricks, all of which are small enough to be handled manually without the use of a crane or other lifting device. In the preferred embodiments, only the flue port sleeve of FIG. 60 weighs more than 20 kg. The most frequently used bricks in a wall are the large and small hammer head bricks of FIGS. 27 and 28 and the flue wall brick of FIG. 40 and these bricks typically have weights of 19 kg, 13 kg and 10 kg respectively. As seen in FIGS. 2 and 3, the walls 4 include a plurality of vertically extending flue cavities 14 within which are alternatively located low and high burners 16 and 18.

In the arrangement of FIG. 3, a horizontal flue 20 is included as in a typical Wilputte battery construction. Located above the horizontal flue 20 are a plurality of inspection cavities 22 formed in the upper oven wall 24. In use, combustion gases enter the burner 16 and 18 from below and air is introduced to the lower ends of the flue cavities 14 so that combustion takes place in a somewhat distributed manner within the walls. Combustion gases pass upwardly through the flue cavities 14 and enter the horizontal flue 20 through flue ports 26. The effective opening of the flue ports 26 can be controlled by the dimensions of the components which make up the flue ports 26 as well as by means of movable slide bricks 28, the positions of which can be adjusted by access through the inspection cavities 22. Normally in a Wilputte battery, the burners on one side of a wall are operated whilst those on the other side of the wall are not and flue gases are arranged to pass upwardly through the cavities with active burners along the horizontal duct and then downwardly through the flue cavities 14 of the non-operative burners. Operation of the burners is sequenced so as to achieve generally uniform heating throughout the battery, in the usual way. Other sequencing variations are possible to achieve uniform heating.

Figure 4:
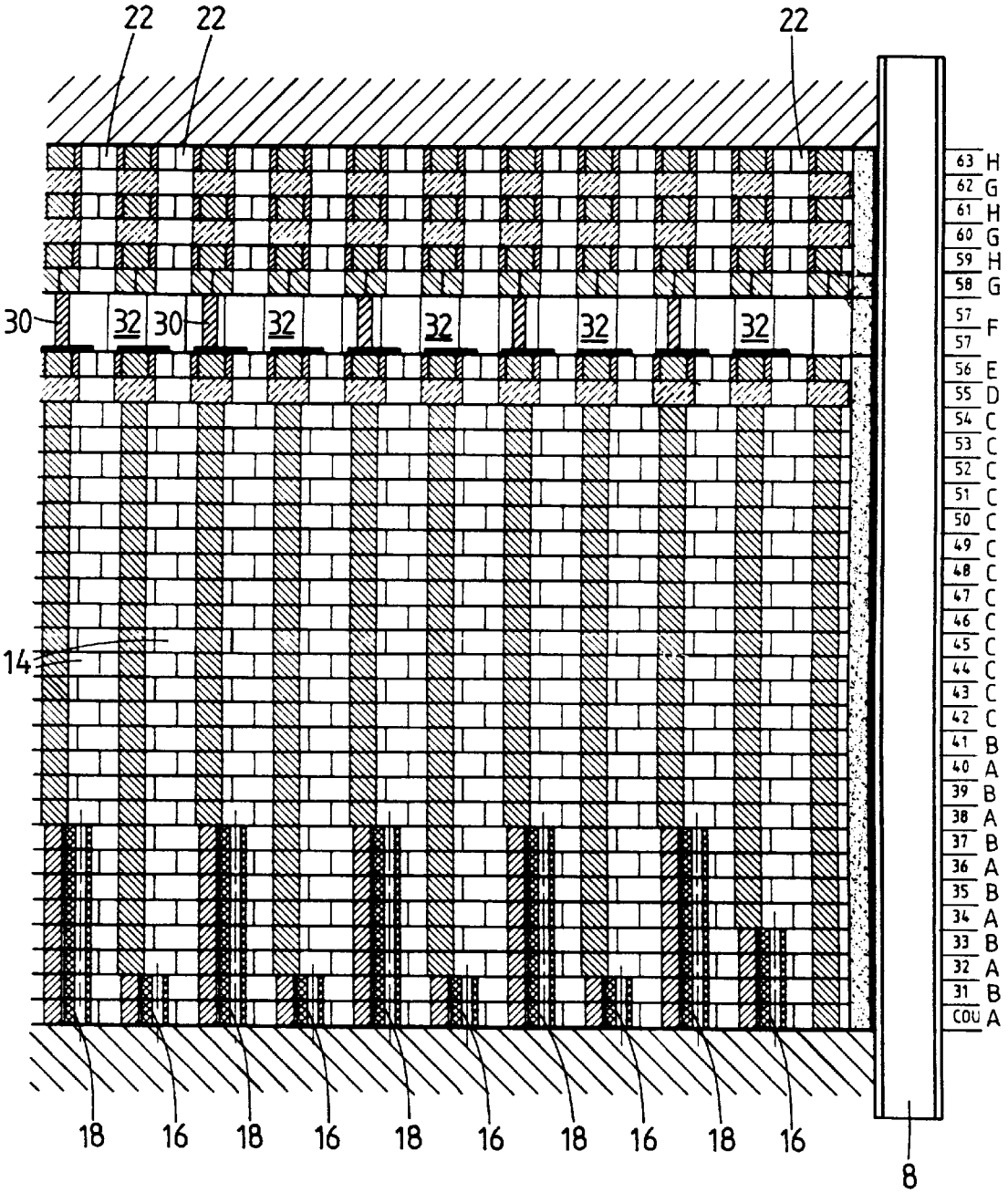
FIG. 4 is a schematic vertical section through an oven wall of a twin flue oven.

FIG. 4 diagrammatically illustrates a twin flue arrangement which is typical in an Otto Simon Carves type battery. In this arrangement, baffles 30 are formed in the flue so that the flue gases pass upwardly through the flue cavity 14, over the short horizontal flue or hairpin segment 32 and then down the next adjacent flue cavity, the operation of the burners being alternated so as to provide generally uniform heating. The principles of the invention can be incorporated into both types of battery, as will be apparent from the description below.

In FIGS. 3 and 4, there are a multiplicity of courses of refractory bricks which are used to make the walls 4. These courses are labelled A, B, C, D, E, F, G and H. In a typical configuration, the first ten courses alternate between courses A and B and in these courses the burners 16 and 18 are located. Above the courses A and B are approximately thirteen C courses which essentially define the flue cavities 14. Courses D and E are located on top of the C courses and these provide for effective control of flue gases into the horizontal flue 20. The horizontal flue itself comprises course F. Above course F are alternating courses G and H which provide for structural rigidity in these parts of the wall as well as the inspection cavities 22.

Figure 6:
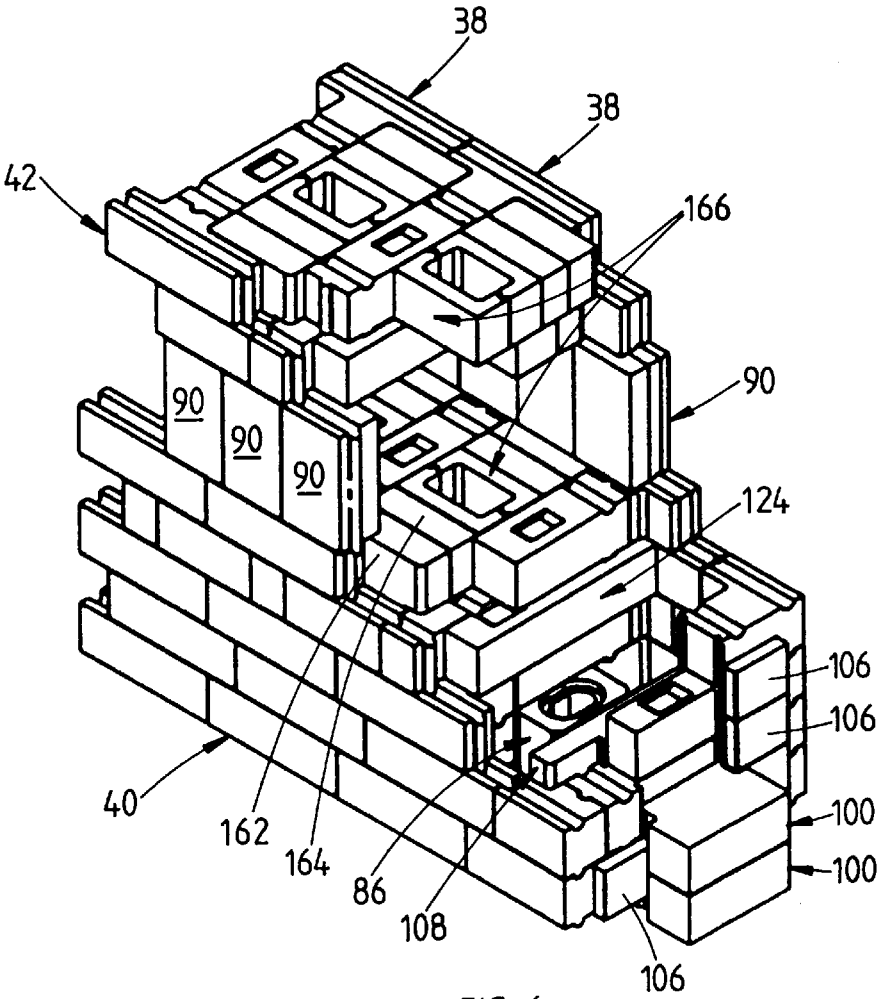
FIG. 6 is a perspective view of the end oven wall of a horizontal flue battery.
Figure 5:
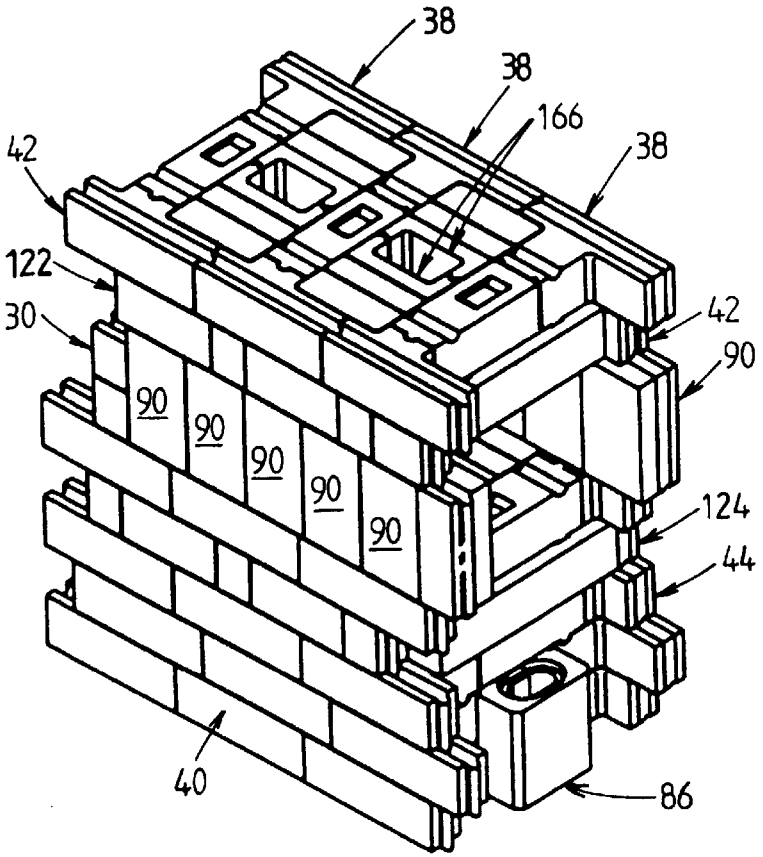
FIG. 5 is a perspective view of part of the horizontal flue.
Figure 7:
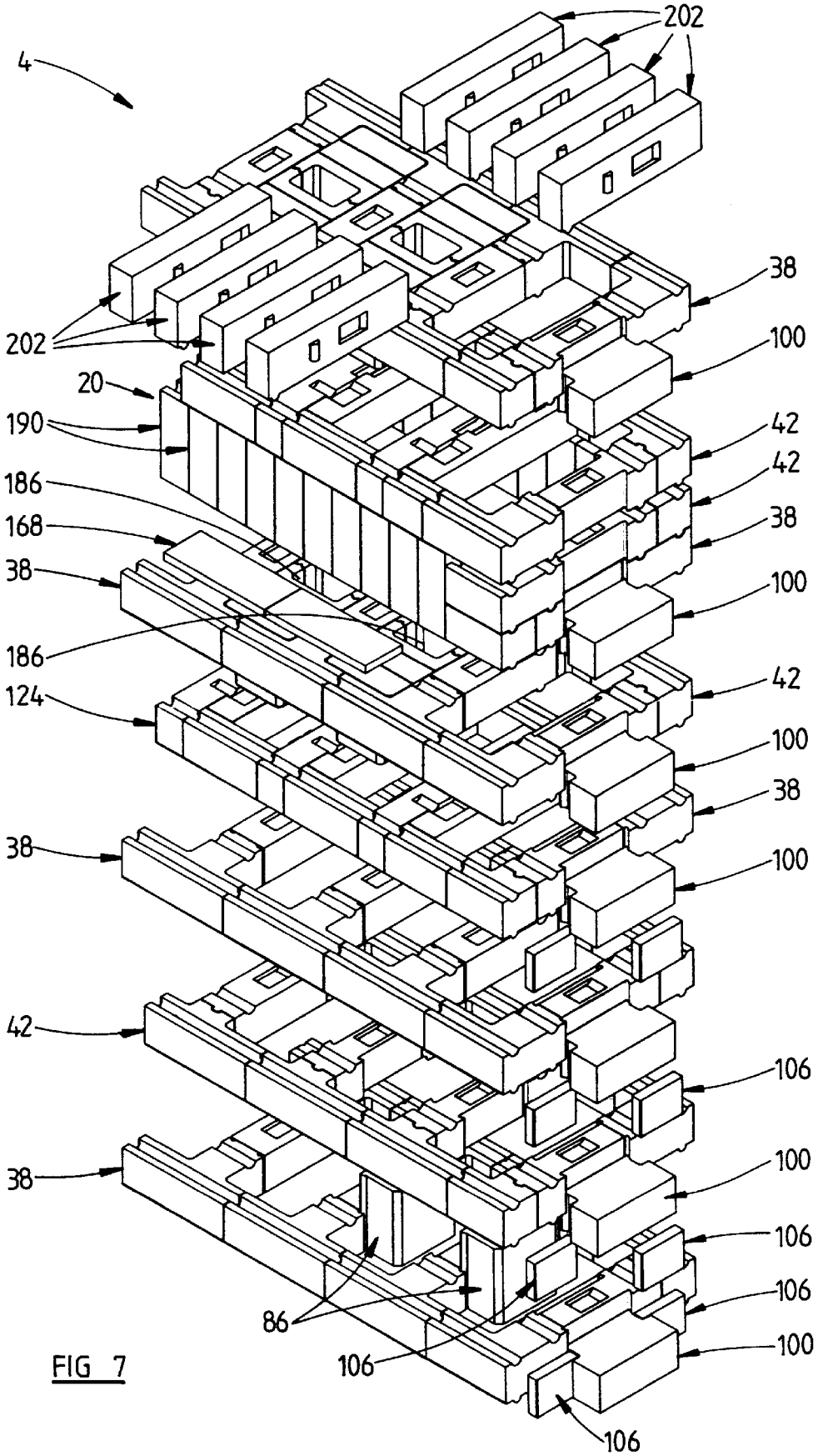
FIG. 7 is a schematic exploded view showing the various courses of an oven wall constructed in accordance with the invention.

FIGS. 5 and 6 are fragmentary perspective views of parts of the wall 4. FIG. 7 is a schematic exploded view showing how various courses overlie one another. FIGS. 11 to 18 show parts of the courses A, B, C, D, E, F, G and H respectively which are used at different parts of the wall from a lower position up to the roof structure.

Figure 11:
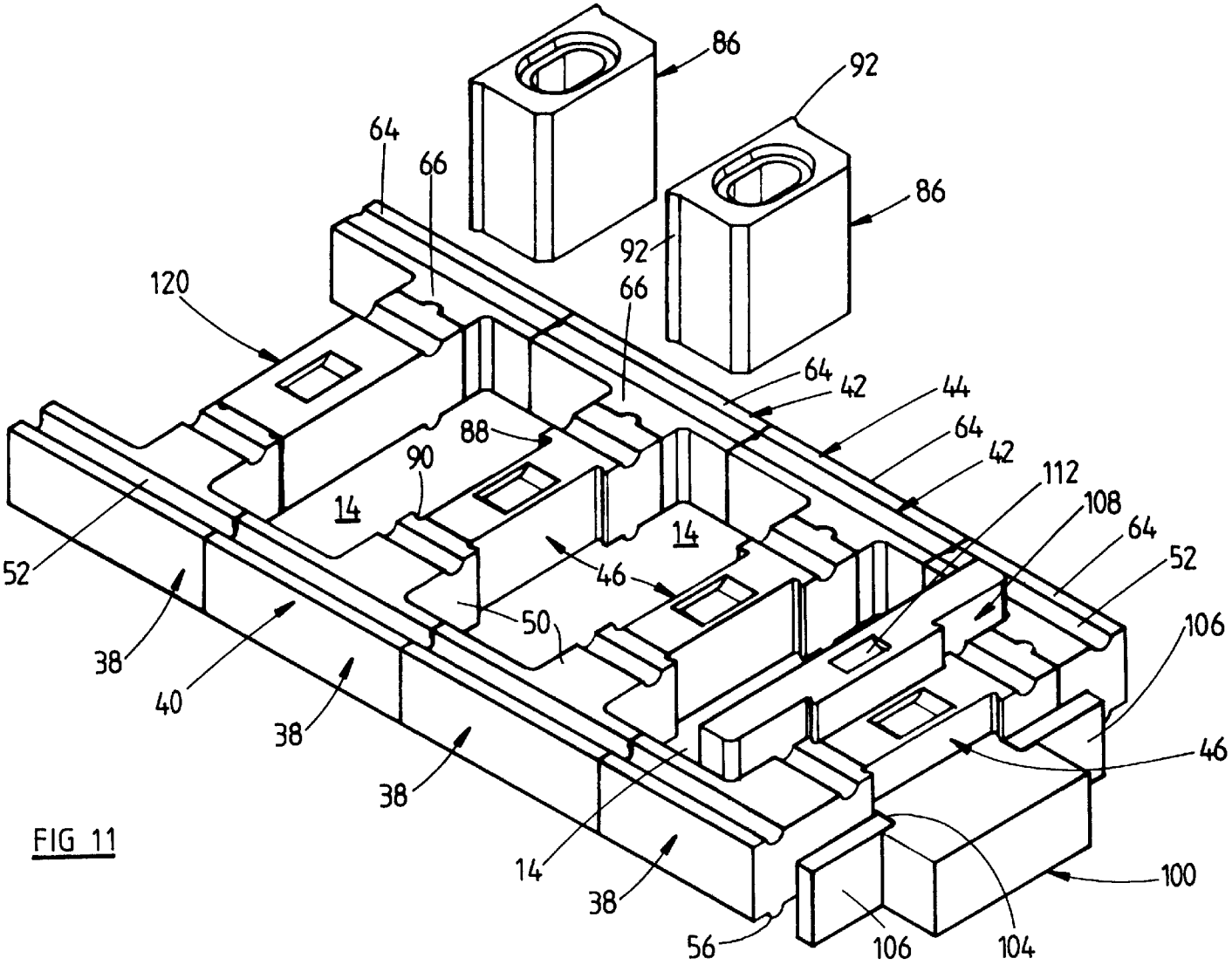
FIG. 11 is a perspective view of one type of brickwork course in the wall, showing burner positioning.

Course A shown in FIG. 11 includes a course of large hammer head bricks 38 which are located along one face 40 of the wall. The course A includes a course of small hammer head bricks 42 which define the opposite face 44 of the wall. Located between the bricks 38 and 42 are burner wall bricks 46.

Figure 26:
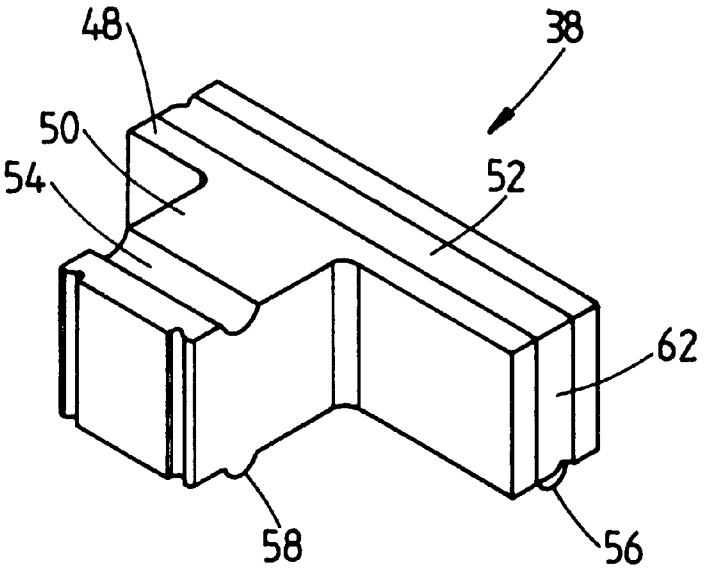
FIG. 26 is an isometric view of a large hammer head brick.
Figure 27:
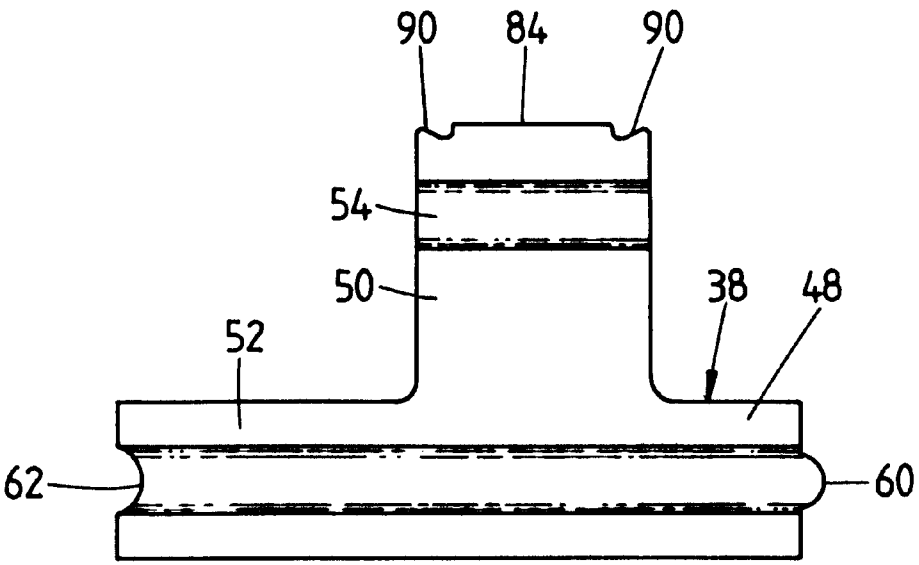
FIG. 27 is a plan view of the large hammer head brick.

The large hammer head brick 38 is illustrated in FIGS. 26 and 27. It will be seen that the brick is of generally T-shaped configuration having a body portion 48 and an inwardly projecting leg 50. The outer face of the body portion 48 forms part of the face 40 (or 44) of the wall 4. The top face of the brick 38 includes a longitudinally extending groove 52 and the leg 50 includes a longitudinally extending groove 54. The lower face of the brick 38 includes a longitudinally extending rib 56 and the leg 50 includes a longitudinally extending rib 58. As best seen in FIG. 27, one end of the body portion 48 includes a vertically extending rib 60 and the other end includes a groove 62. As can be seen in FIG. 11, the bricks 38 in the course A are laid side by side so that the ribs 60 are located within the groove 62 of adjacent bricks. On the other face 44 of the wall, a plurality of small hammer head bricks 42 are laid side by side. These bricks are of generally similar construction to the large hammer head bricks but there are some important differences which will be explained below.

Figure 28:
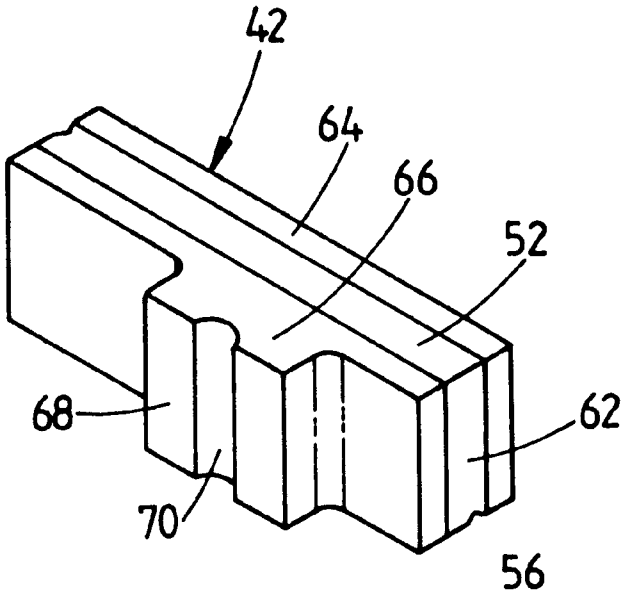
FIG. 28 is an isometric view of a small hammer head brick.
Figure 29:
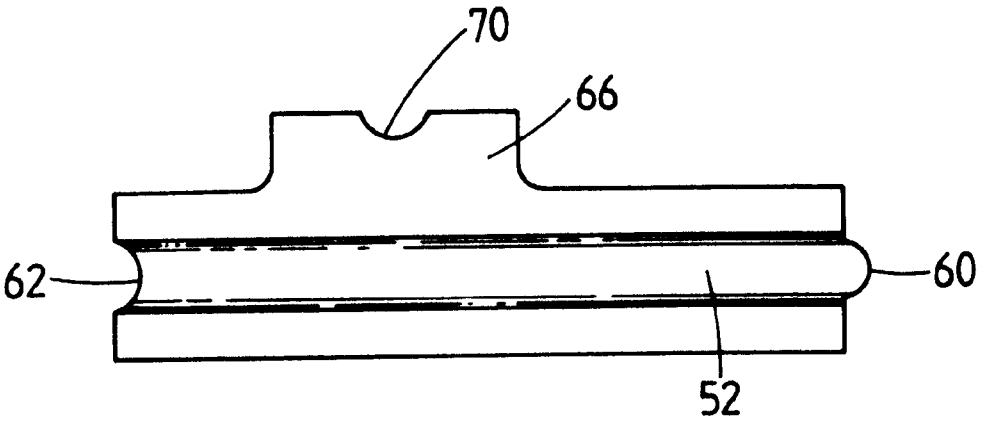
FIG. 29 is a plan view of the small hammer head brick.

FIGS. 28 and 29 show the small hammer head brick 42. These bricks comprise a body portion 64 and a leg 66, the leg 66 being shorter than the leg 50 of the large brick 38. In addition, the end face 68 of the leg 66 includes a vertically extending groove 70. The top, bottom and side faces of the body portion 64 include the same grooves 52 and 62 and ribs 56 and 60 as the large hammer head tile. As can best be seen from FIGS. 27 and 29, the legs 50 and 66 are offset from the centre by the same amount but in a different direction. Thus, the legs 50 and 66 are aligned in the course A, as seen in FIG. 11 because they are on opposite faces 40 and 44 of the wall.

Figure 8:
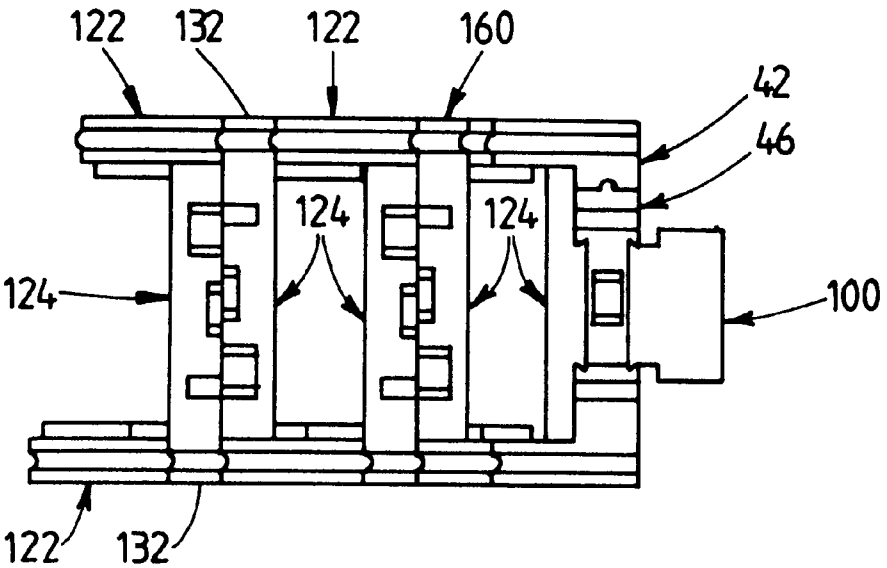
FIG. 8 is a fragmentary plan view of an upper course in an oven wall.
Figure 9:
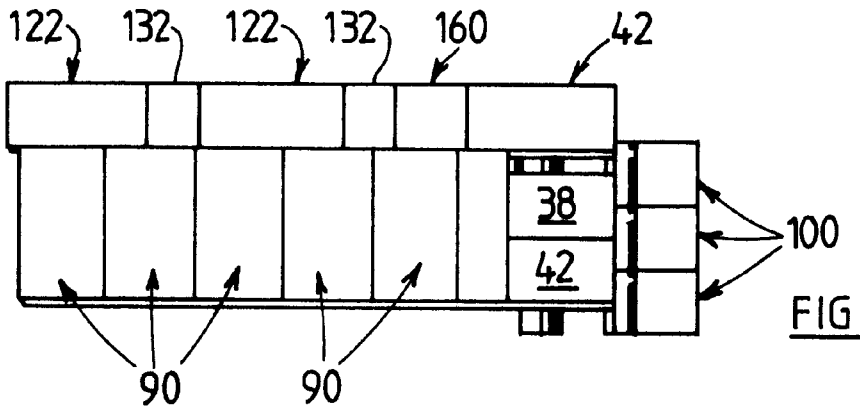
FIG. 9 is a side view of a horizontal flue with a bridging brick above.
Figure 32:
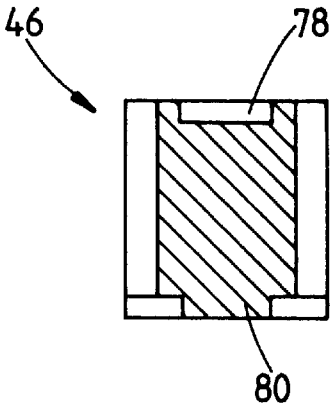
FIG. 32 is a sectional view along the line 32—32.
Figure 31:
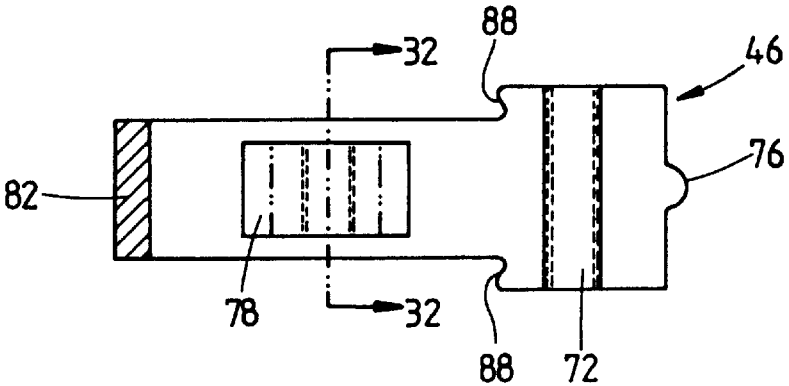
FIG. 31 is a plan view of the burner wall brick.

The burner wall brick 46 is illustrated in more detail in FIGS. 31 to 32. Generally speaking, it fits neatly between the opposed end faces of the legs 50 and 66. The burner brick 46 is generally rectangular but has a longitudinally extending groove 72 on its top face and a longitudinally extending rib 74 on its bottom face. One end face is provided with a vertical rib 76. The top end face includes a concealed recess 78, that is to say a recess which does not extend to the side edges of the brick 46. Located beneath the recess 78 is a projection 80 which again does not extend to the sides of the brick, as best seen in FIG. 32. As best seen in FIG. 8, the rib 76 is received within the groove 70 of the brick 42 and the opposite end face 82 of the burner wall brick abuts the adjacent end face 84 of the leg 50 of the brick 38. The end face 82 can be cut to length so that the effective spacing between the bricks 38 and 42 can be adjusted to accommodate tapering of the walls as diagrammatically illustrated in FIG. 1. It is envisaged that the end face 82 would be sawn onsite according to size. The various bricks 38, 42 and 46 in the course A would be held together by interlocking and mortaring the joints.

Figure 43:
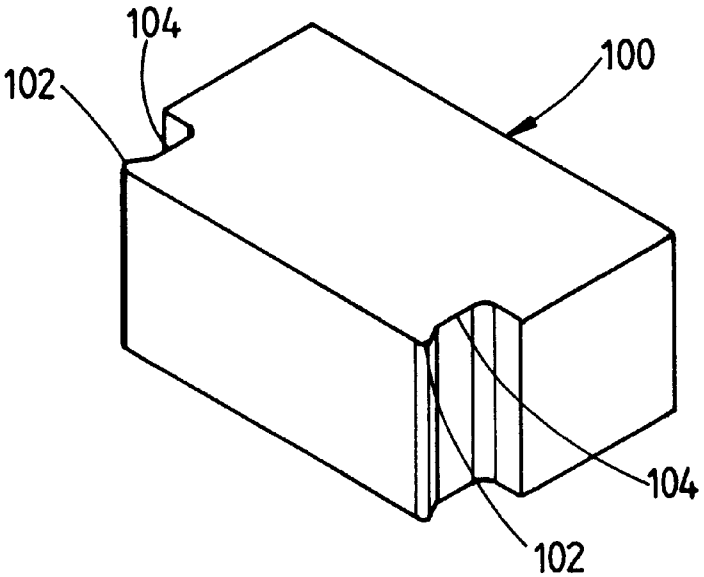
FIG. 43 is an isometric view of a pusher side quoin brick.
Figure 45:
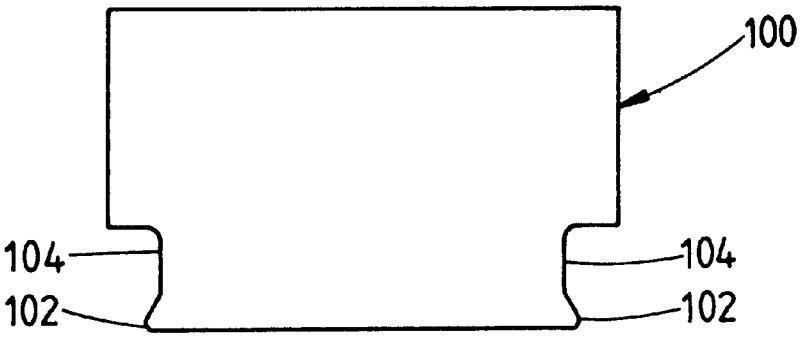
FIG. 45 is a plan view of the quoin brick.
Figure 44:
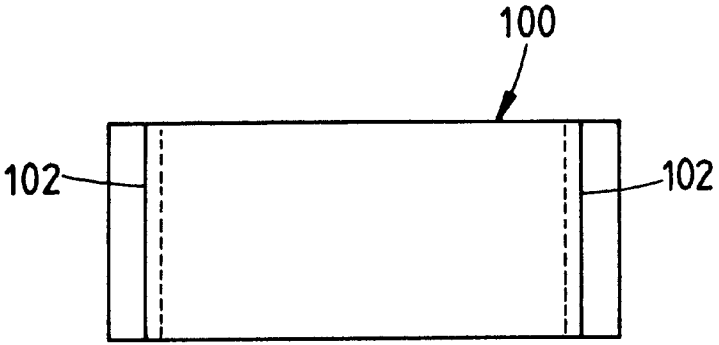
FIG. 44 is a side view of the quoin brick.
Figure 46:
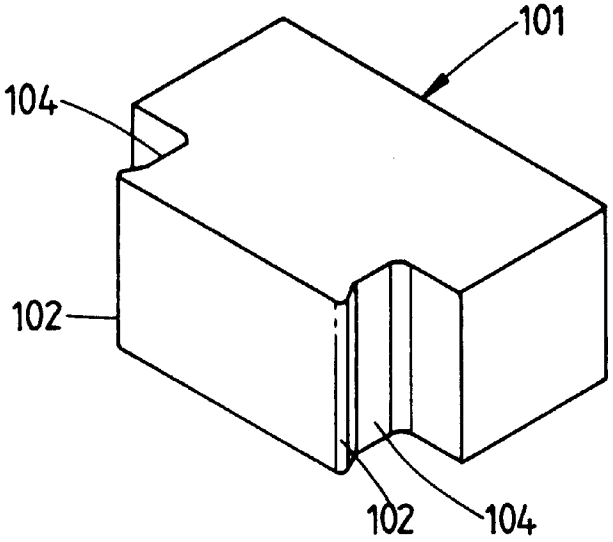
FIG. 46 is an isometric view of a coke side quoin brick.
Figure 48:
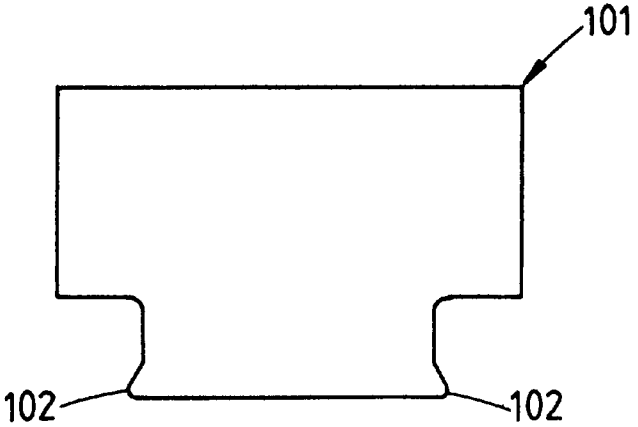
FIG. 48 is a plan view of the coke side quoin brick.
Figure 47:
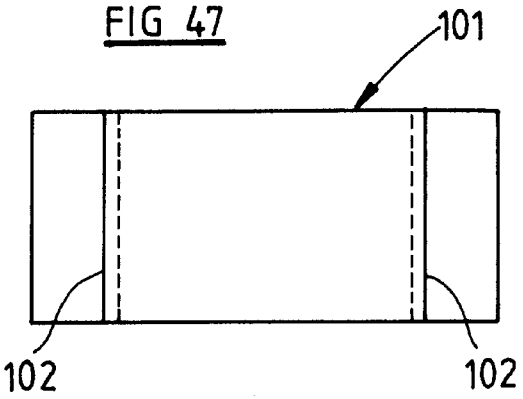
FIG. 47 is a side view of the coke side quoin brick.

FIGS. 7, 8 and 11 also show the preferred way of forming an end of the wall 4. In this arrangement, the end bricks 38 and 42 have part of the body portion thereof removed so that these bricks become generally L-shaped. A quoin brick 100 is then interlocked with the bricks 38 and 46. A quoin brick 100 is diagrammatically shown in FIGS. 43 to 45, this brick being suitable for use at the pusher side 10 of the battery. It will be seen that the brick 100 includes dovetail projections 102 which interlock with the dovetail groove 88 of the brick 46 and the dovetail groove 90 of the brick 38 so as to interlock therewith. The quoin brick 100 includes rebates 104 adjacent to the projections 102 so as to receive end face tiles 106, as shown in FIG. 11. The quoin bricks 100 abut the buckstays 8 and any gaps therebetween are filled with mortar. FIGS. 46, 47 and 48 illustrate a narrower quoin brick 101 which is suitable for use at the coke side 12 of the oven. It otherwise functions in a similar manner to that illustrated in FIG. 11.

Figure 50:
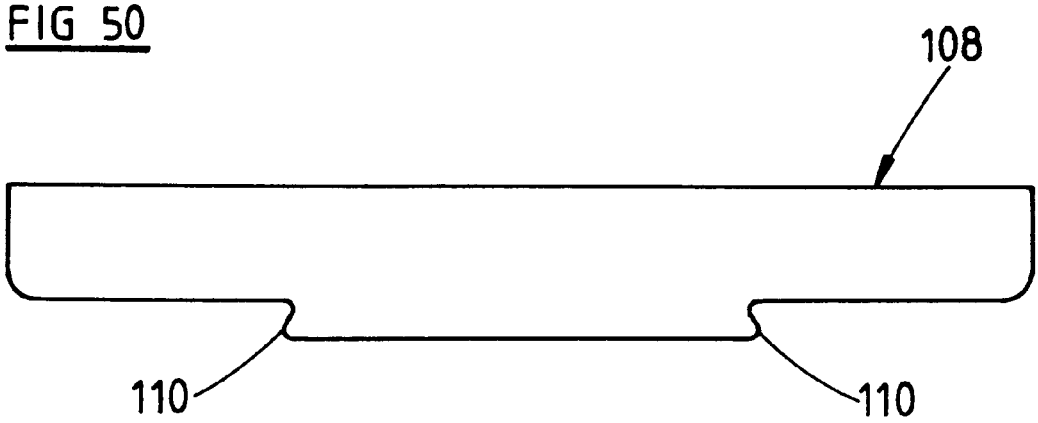
FIG. 50 is a plan view of the pusher side face brick.
Figure 49:
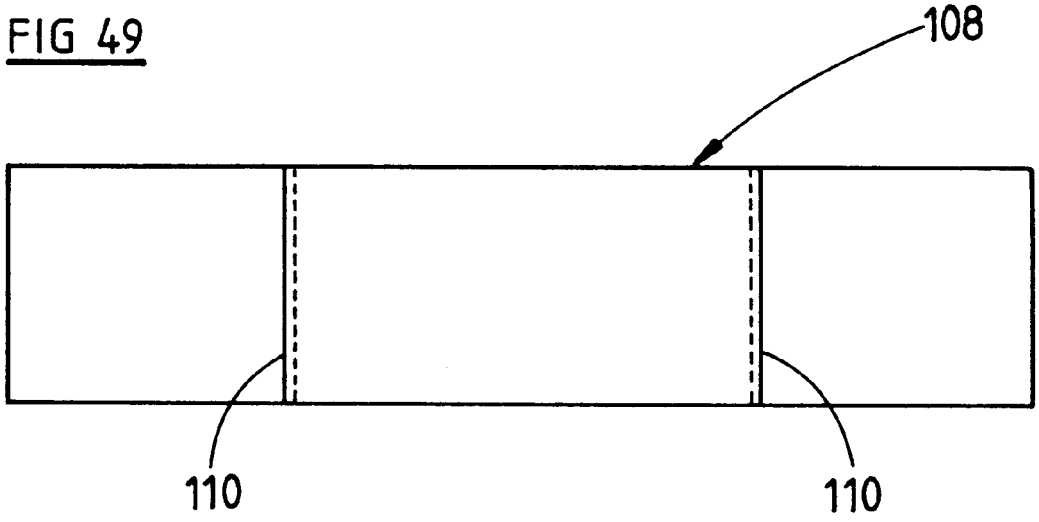
FIG. 49 is a side view of a pusher side face brick.
Figure 71:
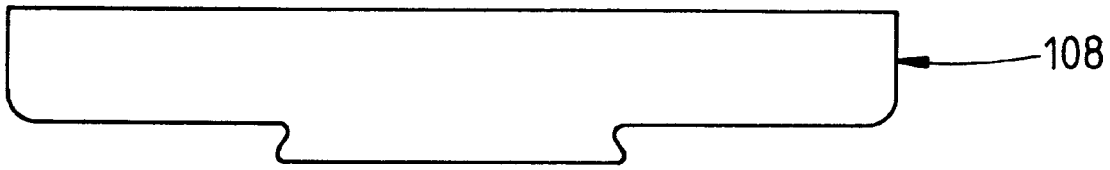
FIG. 71 is a plan view of the coke side face brick.
Figure 70:
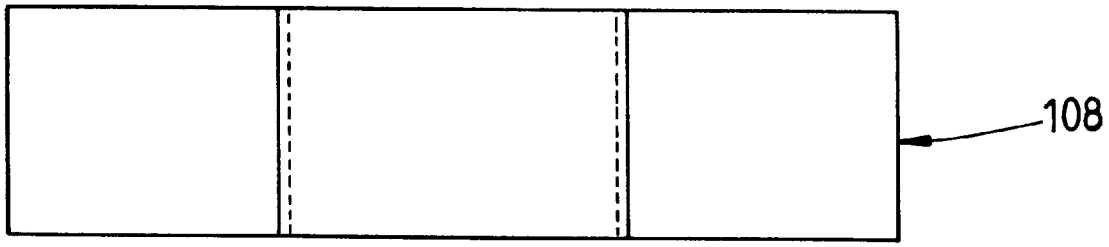
FIG. 70 is a side view of a coke side face brick.

The end flue cavity 14 includes an end face brick 108 which lines the end face of the cavity 14 so as to assist in preventing entry of air into the cavity 14 and to also improve thermal insulation at the end of the wall. The end face brick 108 has on one side face thereof dovetail projections 110. The projections 110 can interlock with the dovetail grooves 88 and 90 of the bricks 46 and 38. The top face of the brick 108 preferably includes a concealed recess 112 but this has been omitted in FIGS. 49 and 50. The end face brick 108 is shown in more detail in FIGS. 70 and 71.

Figure 39:
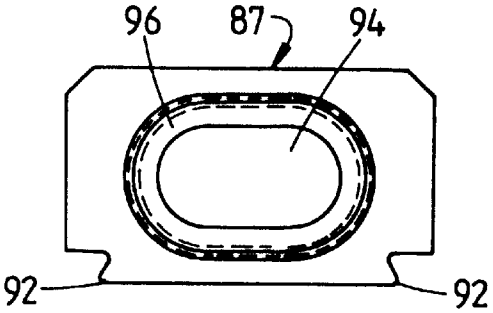
FIG. 39 is a plan view of the burner block (coke side)
Figure 38:
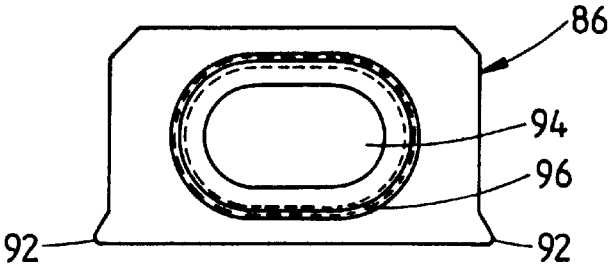
FIG. 38 is a plan view of the burner block (pusher side)

FIG. 11 also diagrammatically illustrates the manner in which burner blocks 86 are supported in the flue cavities 14 defined between the bricks 38, 42 and 46. It will be noted that the side faces of the burner wall bricks 46 include dovetail grooves 88. Also, the end face 84 of the leg 50 includes dovetail grooves 90. The burner blocks 86 include dovetail projections 92 which are received within opposed dovetail grooves 88 and 90, as best seen in FIGS. 7 and 8. In order to accommodate the tapering of the walls, the burner blocks 86 are moulded with eight shapes which have incrementally decreasing spacing between the dovetail projections 92. FIG. 38 diagrammatically shows a pusher side burner block where the projections 92 are widely spaced whereas FIG. 39 shows a coke side burner block 87 where the projections 92 are relatively narrowly spaced. These blocks can be hand cast in a single mould with sliding plates to give the correct spacing for the projections 92.

Figure 36:
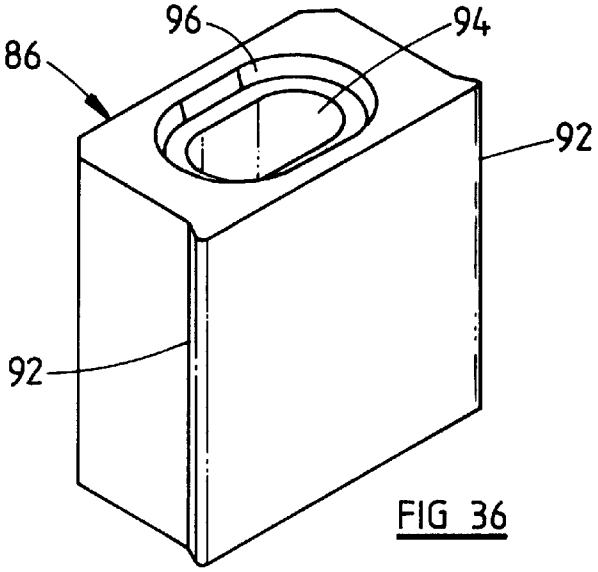
FIG. 36 is an isometric view of a burner block.
Figure 37:
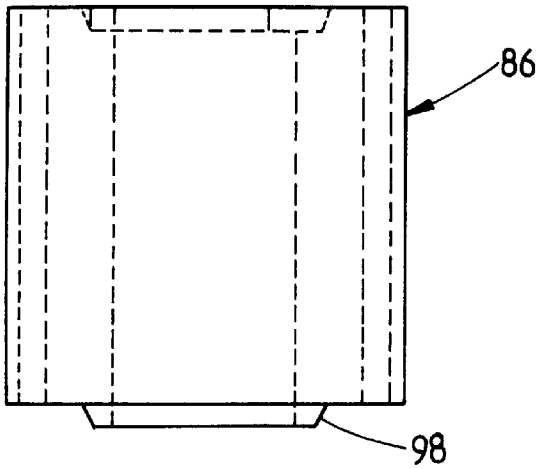
FIG. 37 is a side view of the burner block.

FIGS. 36 to 38 diagrammatically illustrate the burner block 86 in more detail. It will be seen that it is of generally rectangular configuration having a central passage 94 through which combustion gases can pass. A rebate 96 is formed adjacent to the passage 94 at the top face of the block. A projecting boss 98 is formed on the lower face of the block so that when the blocks are laid one on top of the other, the boss 98 of the uppermost block will be located within the rebate 96 of the lowermost block. The blocks 86 are double the height of the bricks 38 and 42 so that they extend across two courses. FIG. 39 shows a narrower burner block 87 which is suitable for use in the narrower parts of the wall, that is to say those parts of the wall closer to the coke side 12. It will be seen that its projections 92 are more closely spaced that those of the brick 86.

As mentioned previously, all joints between the bricks are mortared. In the arrangement described above, the recess 78 is relatively wide so that the projection 80 can be accommodated therein, notwithstanding adjustments made in the relative positions. Because the recess 78 and projection 80 do not extend to the sides of the top face of the burner wall brick 46, there is substantially less opportunity for escape of gas or mortar loss through these interlocking parts. The concealed rebate is important to ensure mortar stays in the groove. Any loss of mortar negates the interlocking characteristics of the wall. Further mortar that may fall out of these joints may lodge in the burner risers or flue ports and block the passage of air or gas. This is a disadvantage in known arrangements. It will be further appreciated that the interlocking of the grooves 52 and ribs 56, as well as the interlocking between grooves 54 and ribs 74, are not subject to the same constraints because these are always aligned by virtue of the fact that they are at fixed spacings relative to the faces 40 and 44 of the wall. Accordingly, misalignments are not likely to occur at these points.

Figure 12:
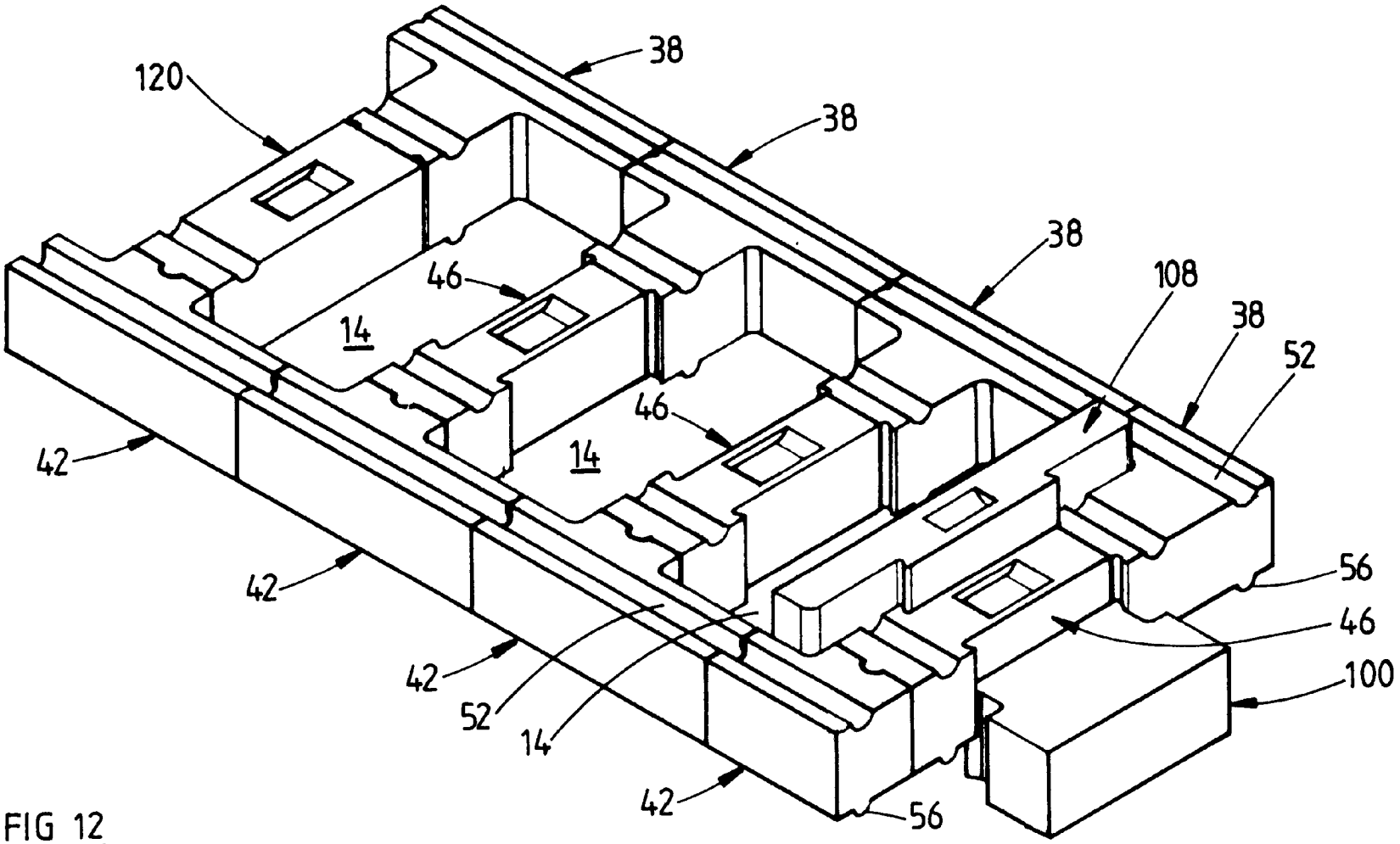
FIG. 12 is a perspective view of the adjacent course of brickwork showing alternation of the joints.

Course B is illustrated in FIG. 12. It is essentially the same as course A except that the small hammer head bricks 42 are located above the large hammer head bricks 38 and vice versa. It will be appreciated that because the legs 50 and 66 are offset by the same amount but in opposite centres when their positions are alternated in courses A and B, the body portions will be vertically aligned. Further, the body portions 48 and 64 will form a bond pattern on the wall faces 40 and 44, as diagrammatically illustrated in FIGS. 5 and 6. The bond pattern enhances stability of the wall.

Figure 19:
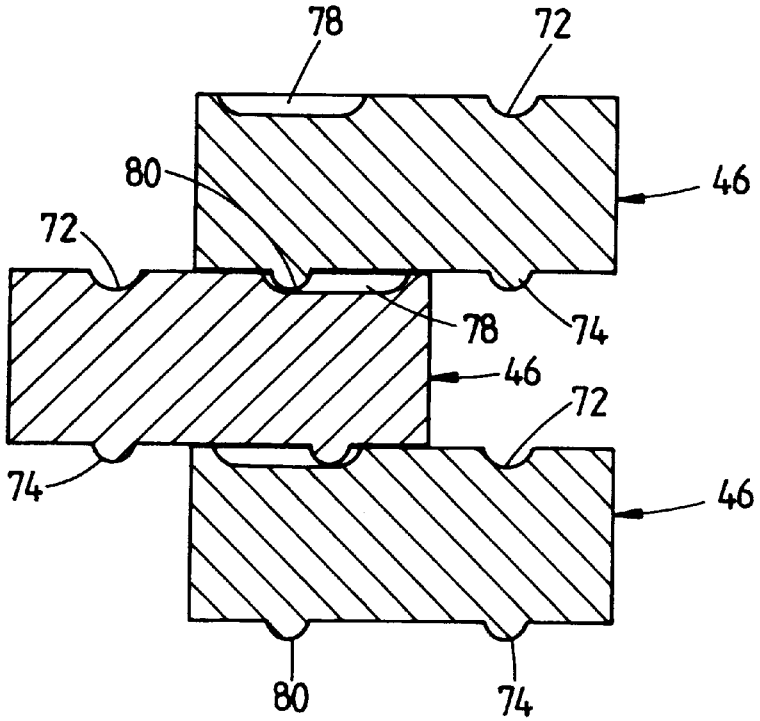
FIGS. 19 and 20 are sectional schematic views showing interlocking of flue wall bricks.
Figure 20:
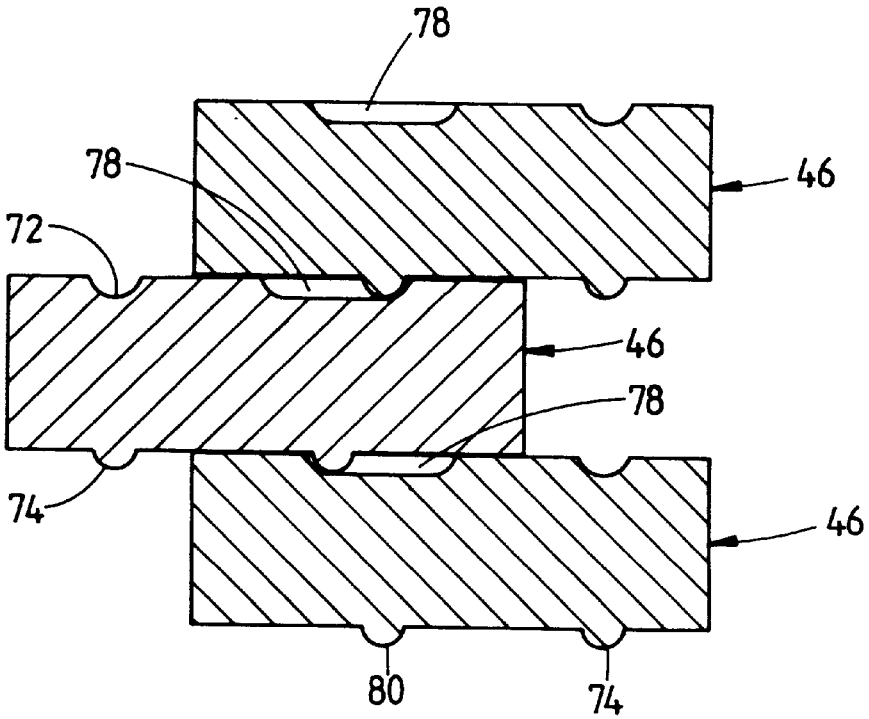
Figure 21:
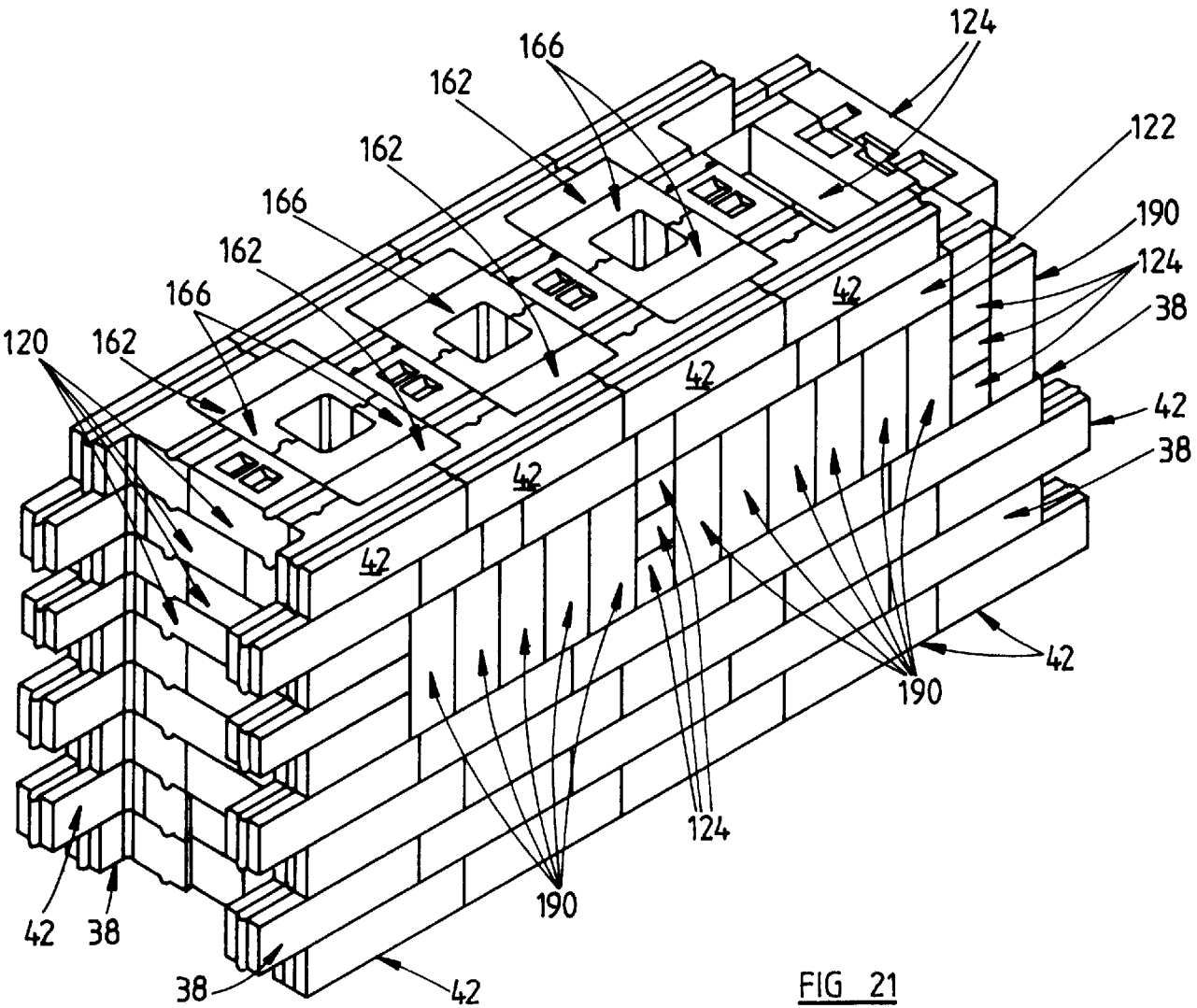
FIG. 21 is a perspective view of part of a twin flue oven wall.
Figure 30:
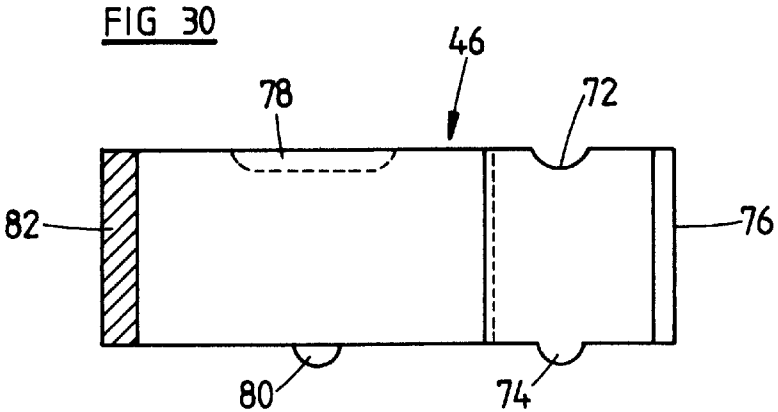
FIG. 30 is a side view of a burner wall brick.

It will also be appreciated from FIGS. 11 and 12, that the ribs 56 on the lower faces of the bricks 42 will be received within the grooves 52 of the bricks 38 and the same interlocking will occur on the other side of the wall. Further, the rib 74 will be received within the groove 54 of the brick 38 and the projection 80 will be received within the recess 78. Also, the rib 58 of the brick 38 will be received in the groove 72 on the top face of the brick 46. In this way there is good interconnection between the burner wall bricks 46 and the bricks 38 and 42. The recess 78 is much wider than the projection 80, as best seen in FIGS. 30 and 31 so that the projection 80 can be received in the recess 78, notwithstanding changes in the effective length of the brick 46, as mentioned above. This is diagrammatically illustrated in FIGS. 19 and 20. FIG. 19 shows relatively narrow spacing of the wall faces as occur at the coke side 12. On the other hand, FIG. 20 shows the relatively wider spacing of the wall faces at the pusher side 10 of the battery. The relative positions of the projection 80 within the recesses 78 is adjusted accordingly.

As diagrammatically shown in FIG. 3, the wall is built up using alternate courses A and B with the burner blocks 86 being located as appropriate to requirements.

Figure 13:
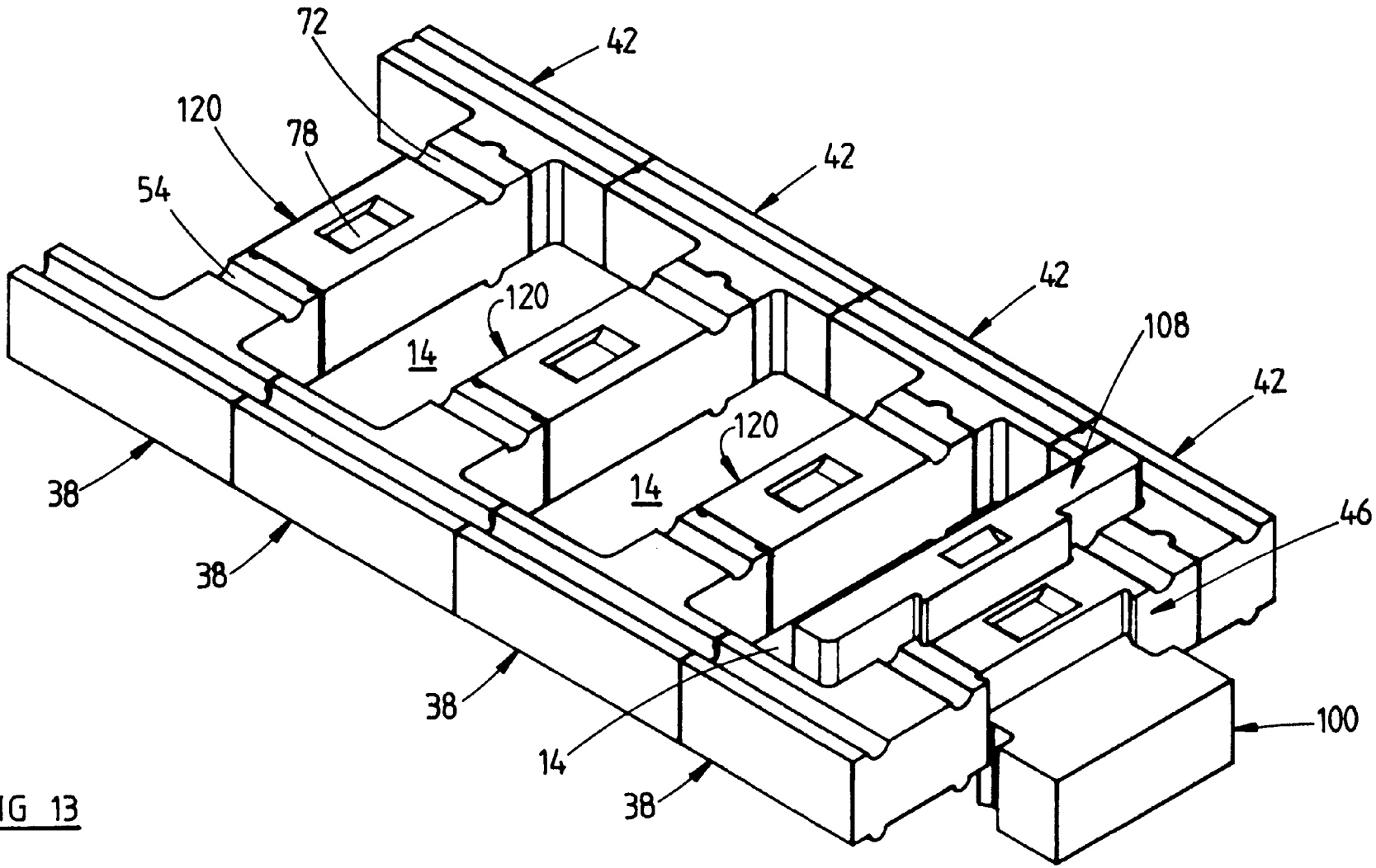
FIG. 13 is a perspective view of another type of brickwork course above the burner courses.
Figure 42:
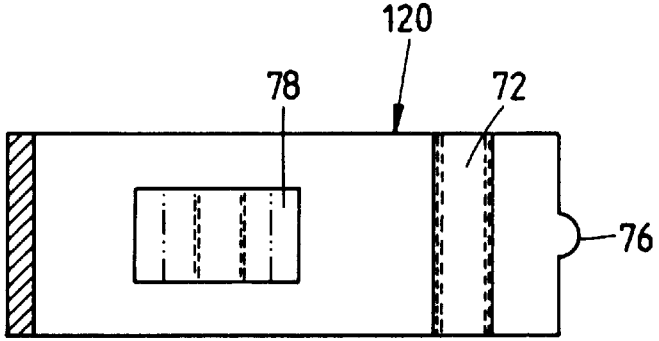
FIG. 42 is a plan view of the flue wall brick.
Figure 41:
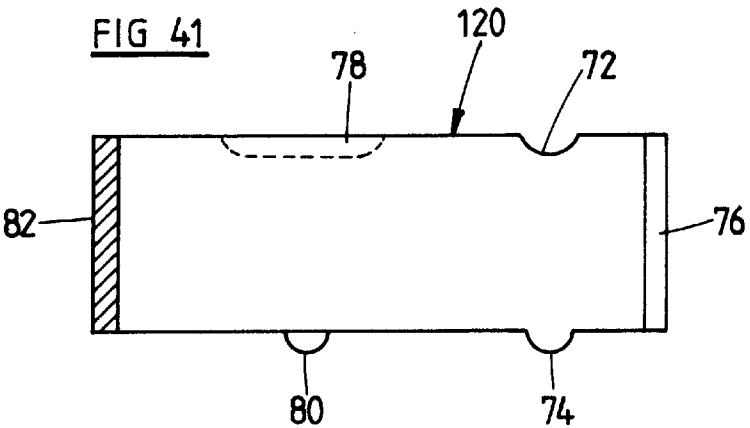
FIG. 41 is a side view of the flue wall brick.

FIG. 13 diagrammatically illustrates course C which is typical of the wall structure above the level of the burners. The illustrated course C is essentially the same as course A except that flue wall bricks 120 are used instead of the burner wall bricks 46. The flue wall brick 120 is illustrated in more detail in FIGS. 40 to 42. It is generally the same as the burner wall brick 46 except that it is of generally uniform thickness along its length and need not include the dovetail projections 88. The same reference numerals have been used to denote corresponding parts to the brick 46. Its interlocking function is essentially the same as that of the bricks 46, except that it does not need to interlock with the burner blocks 86. At the end of the wall, a burner wall brick 46 is used so that its dovetail projection 88 can interlock with the projections of the quoin brick 100 as well as those of the end face brick 108. In alternate courses C, the locations of the bricks 38 and 42 on the sides of the wall are reversed so as to continue the bond pattern on the outer faces 40 and 44 of the walls, as described above in relation to courses A and B.

In courses A and B where burner blocks 86 are not located in cavities 14, the flue wall bricks 120 can be used in place of the burner wall bricks 46.

Figure 14:
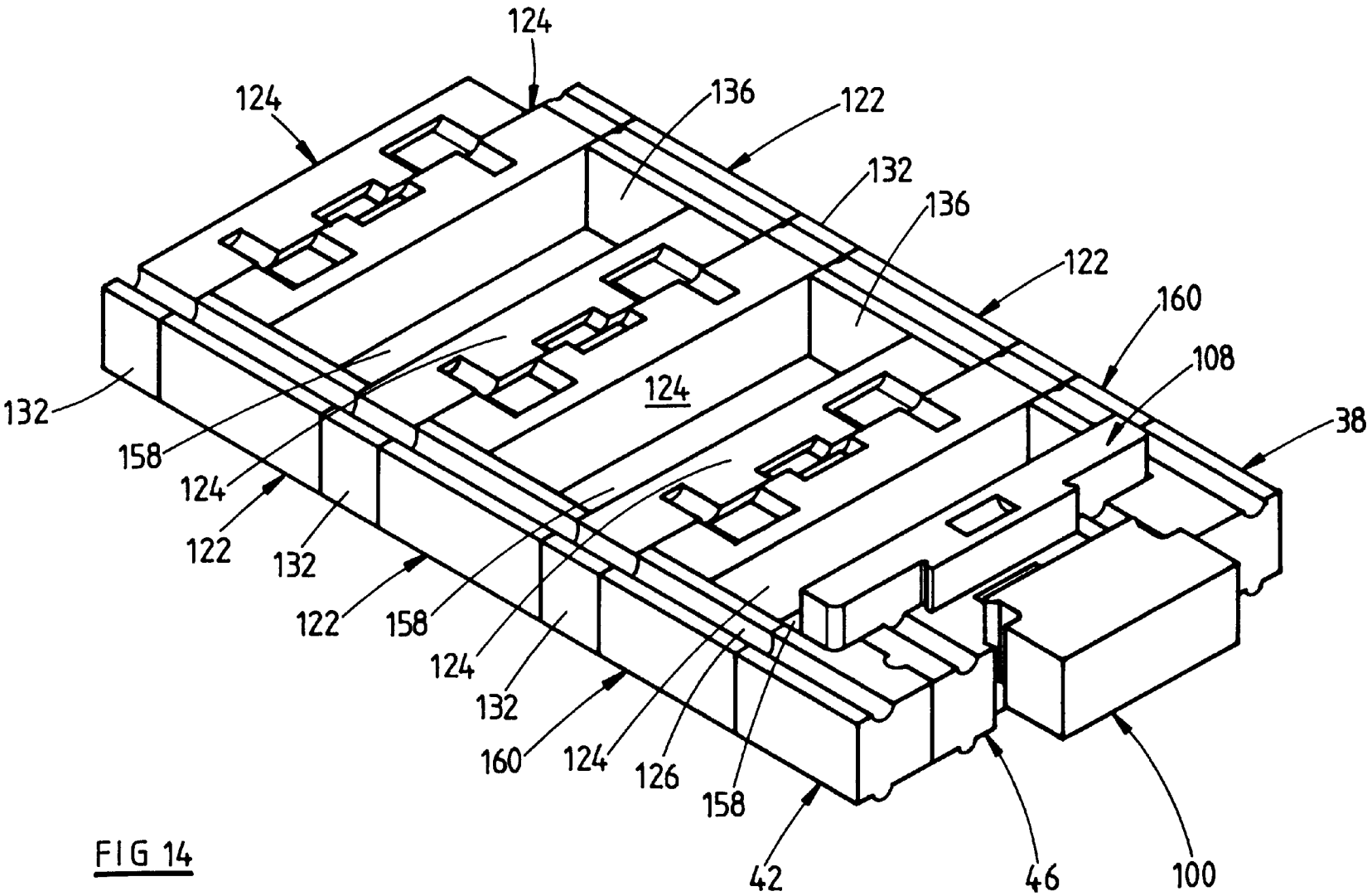
FIG. 14 is a perspective view of another type of brickwork course showing the bridging brick.

Courses D and E are illustrated in FIGS. 13 and 14 respectively. These courses are chiefly concerned with control of admission of flue gases into the horizontal flue 20. These courses are also structured so as to provide additional structural integrity at the horizontal flue 20 which is traditionally a weak area in the brick work structure.

Figure 10:
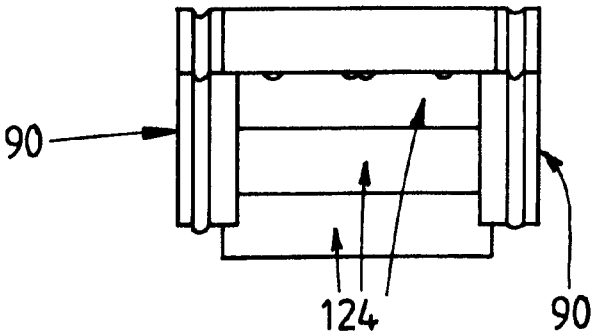
FIG. 10 is an end view of a horizontal flue battery at the horizontal flue.
Figure 66:
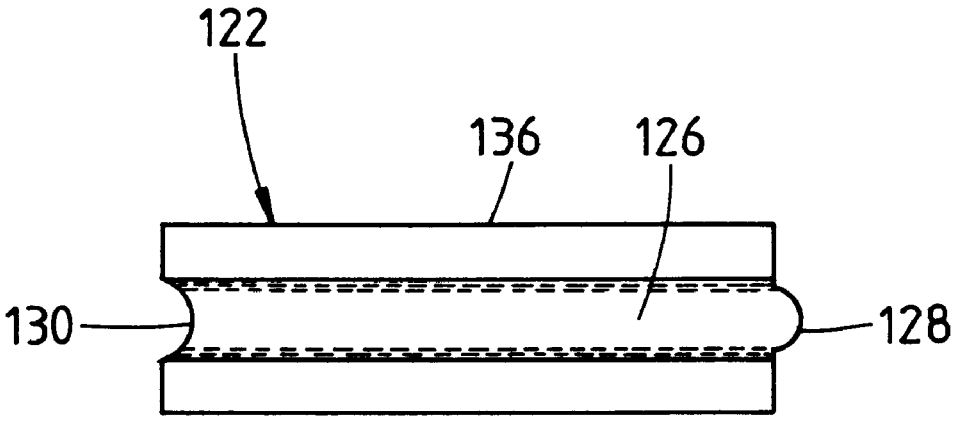
FIG. 66 is a plan view of the liner brick.
Figure 65:
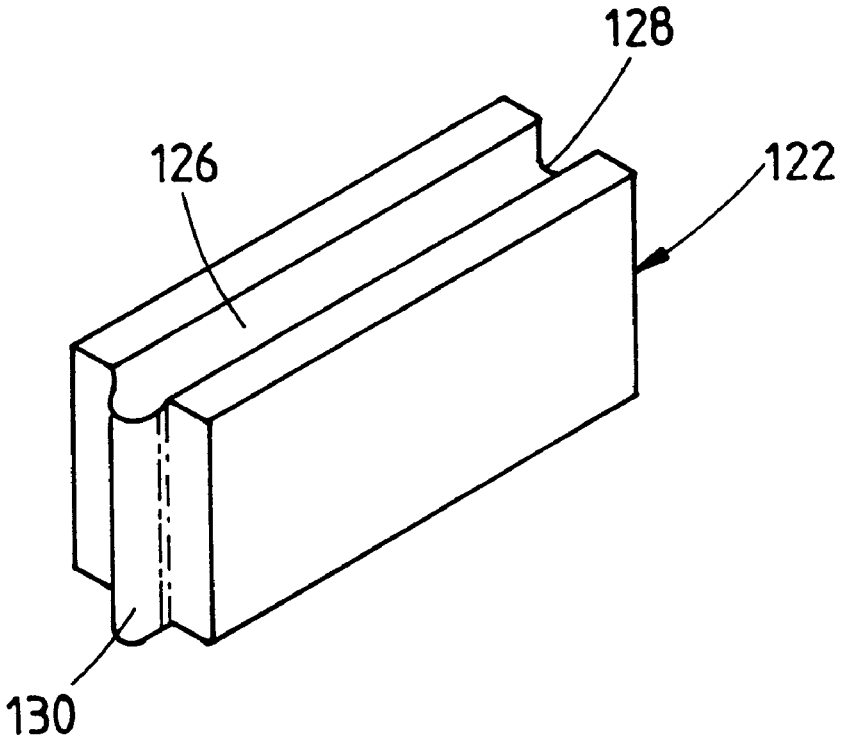
FIG. 65 is an isometric view of a liner brick.
Figure 68:
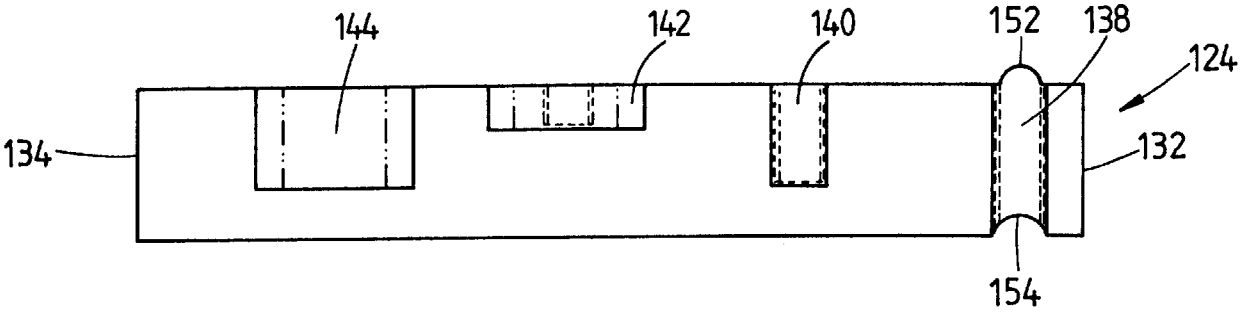
FIG. 68 is a plan view of the bridging brick.
Figure 67:
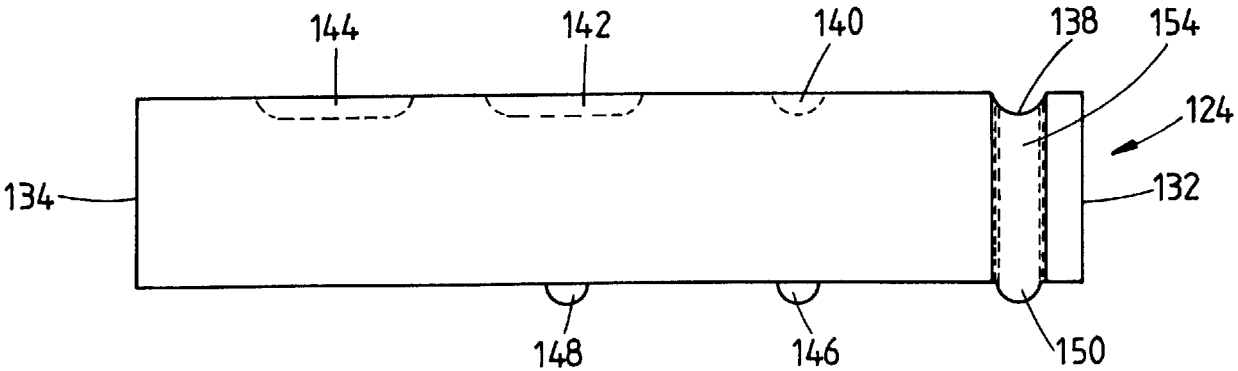
FIG. 67 is a side view of a bridging brick.
Figure 69:
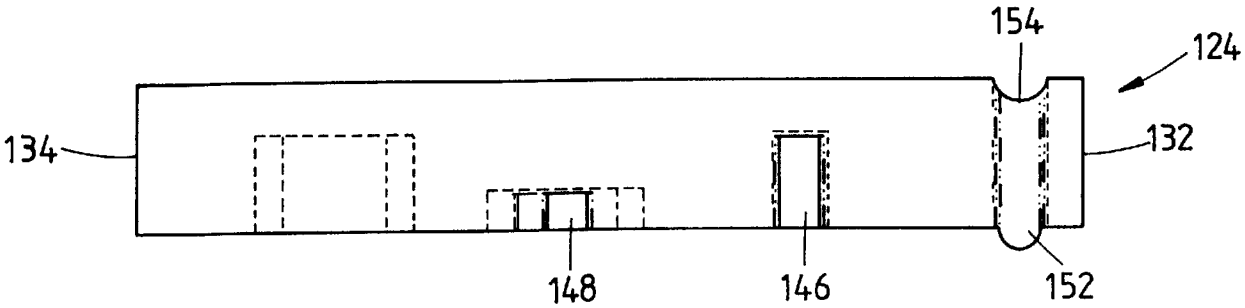
FIG. 69 is an underside view of the bridging brick.

The course D includes liner bricks 122 which are illustrated in FIGS. 65 and 66 together with bridging bricks 124 which are illustrated in FIGS. 67, 68 and 69. The liner brick 122 is similar to the body portion 48 of the large or small hammer head brick 38 or 42 except that it is somewhat shorter in length. It is provided with a longitudinally extending groove 126 on its top face. It is also provided with a longitudinally extending rib (not shown) on its lower face which is received within the aligned grooves 52 of the uppermost course C. The liner brick 122 also includes a vertically extending groove 128 and rib 130 on its end faces. The bridging brick is shown in more detail in FIGS. 66 to 68. It will be seen that the bridging brick 124 is long enough so that it can span substantially across the width of the wall. It is provided with an end face 132 which forms part of the exterior face 40 or 44 of the wall. It has an inner face 134 which can be trimmed or cut to length so as to bear against an inside face 136 of the liner brick 122. The top face of the bridging brick 124 includes a longitudinally extending groove 138 and three recesses 140, 142 and 144. The recesses 140, 142 and 144 extend to one side of the brick as best seen in FIG. 67. The lower face of the brick 124 includes projections 146 and 148 which are generally complementary to and are located beneath the recesses 140 and 142 respectively. The lower face of the brick also includes a transverse rib 150, the rib 150 being transverse to the brick 124 but extending longitudinally relative to the wall. One side face of the brick includes a vertically extending rib 152 and the other face includes a vertically extending groove 154. The course D has liner bricks 122 interlocking with the bricks 38 and 42 in the course below. Pairs of bridging bricks 124 are then laid such that their faces 132 form part of the respective walls 40 and 44. The ribs 152 are received within the grooves 52 in the course beneath. In addition, the ribs 152 of the bricks 124 are received in the grooves 128 of the bricks 122 in the course. Similarly, the ribs 130 of the bricks 122 are received in the grooves 154 of the bridging bricks. As best seen in FIGS. 8, 10 and 14, the width of the bridging brick 124 and the length of the liner brick 122 are such that their combined lengths is the same as the lengths of the head portions of the bricks 38 and 42. This enables a general continuation of the bond pattern in the faces 40 and 44 of the walls.

It will also be seen from FIG. 14 that the pairs of opposed bridging bricks 124 are arranged such that the recesses in their top faces are aligned. The central recesses 142 are aligned with each other but the recesses 140 and 144 are oppositely aligned. The aligned recesses enable interlocking with ribs in the bricks of course E above which will be described later.

Figure 14A:
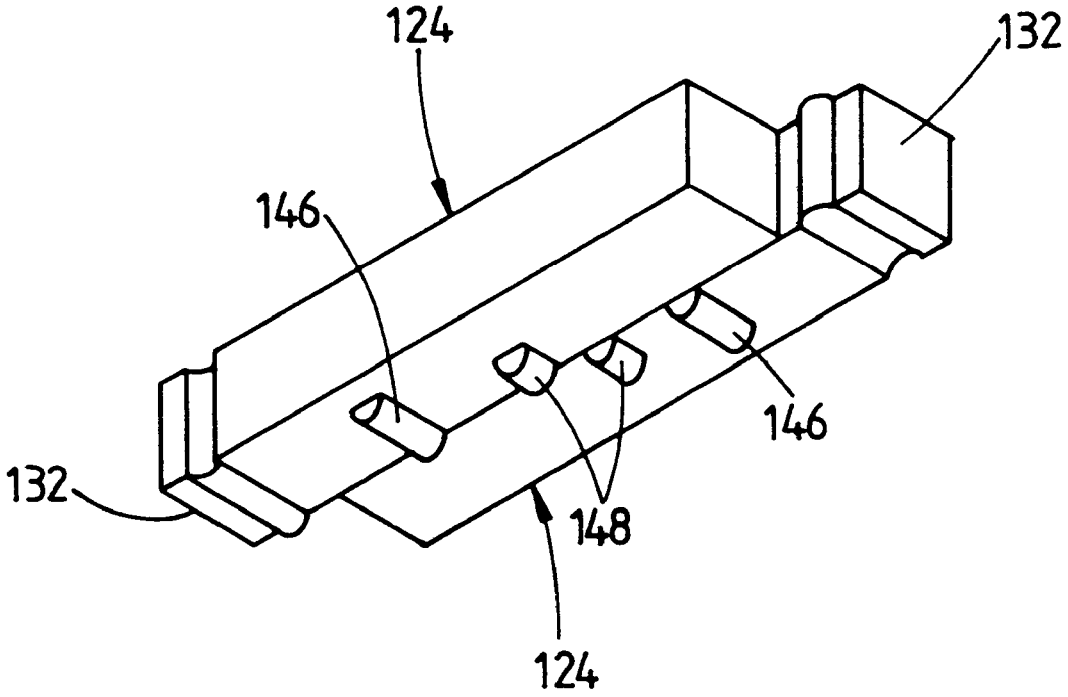
FIG. 14*a* is a perspective underside view of two bridging bricks.

The pairs of bridging bricks 124 are located above and are supported by the legs of the bricks 38 and 42 and the flue wall bricks 120. The widths of the bridging bricks 124 are somewhat narrower than the widths of the flue wall bricks 120 so that each brick 124 can be supported. In addition, the projections 146 and 148 on the bottom face of the bridging bricks cooperate with the grooves and recesses formed in the top faces of the legs of the hammer head bricks and the flue wall bricks 120. More particularly, the projections 148 will be received within the recesses 78 of the bricks 120. The bricks 124 on the right hand side of the pairs thereof (as seen in FIG. 14) will have their projections 146 received in the grooves 54 of the bricks 38. The bricks 124 on the left hand side of the pairs will have their projections 146 received within the grooves 72 of the flue wall bricks 120. This provides for good interlocking. As mentioned above, the face 134 of the bricks 124 can be trimmed or cut to take into account the tapering of the walls. This does not present any problem for interlocking of the projections 146 in the grooves 54 or 72 but the variation of position of the projection 148 can be accommodated because of the relatively large size of the recesses 78. Thus, variations can readily be accommodated in an analogous manner to that illustrated in FIGS. 19 and 20. The relative location of the projections 146 and 148 in the pair of bridging bricks 124 is diagrammatically illustrated in FIG. 14*a*.

As can also be seen from FIG. 14, course D includes flue cavities 158 which communicate with the flue cavities 14 but are of smaller cross-sectional dimensions. These cavities are filled in part by bricks from Course E as will be described below.

It will also be seen from FIG. 14 that the end construction of the wall is analogous to the other courses. It may, however, be necessary to cut some of the liner bricks to length at the end, as indicated by cut liner bricks 160.

Figure 15:
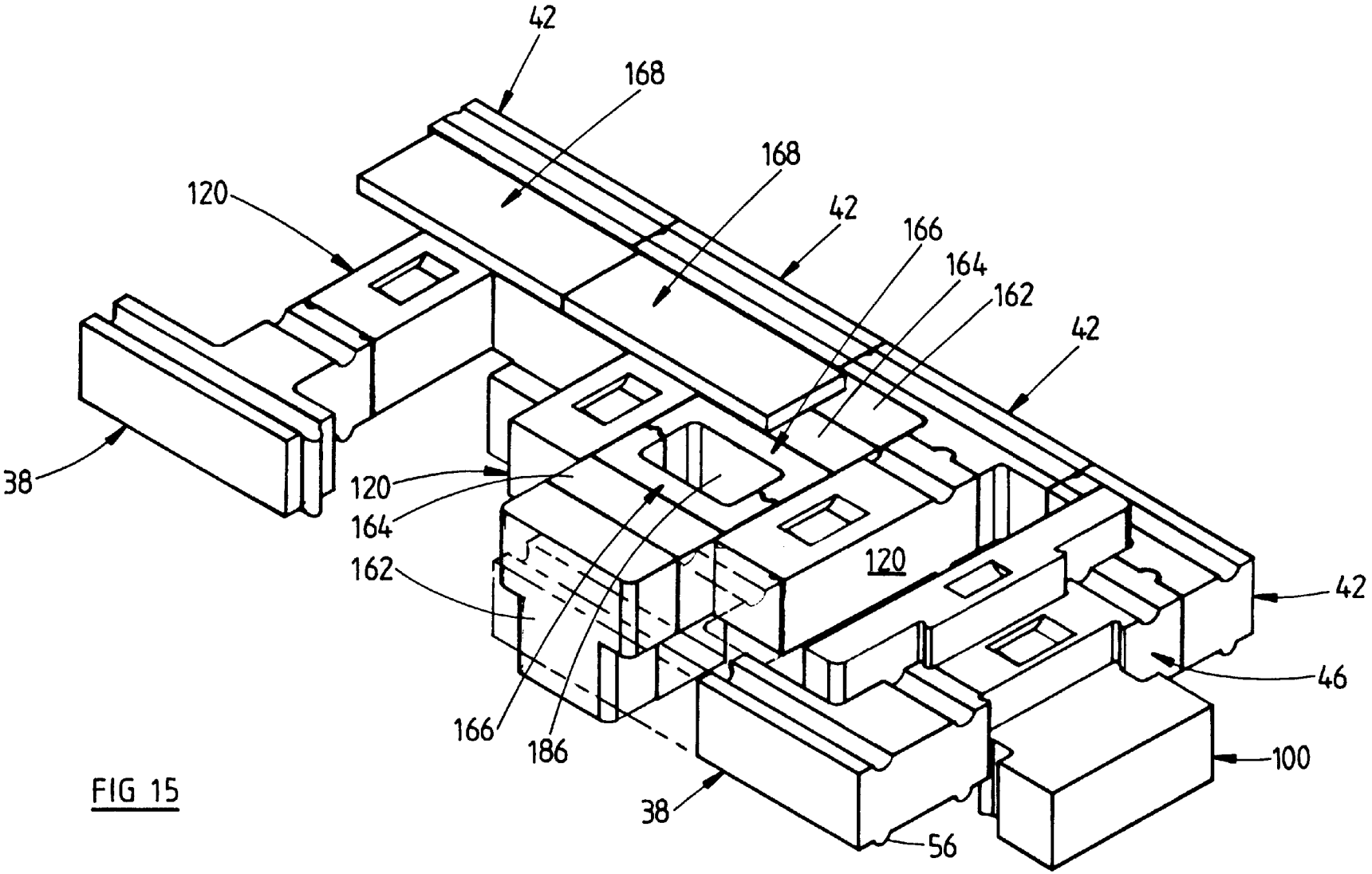
FIG. 15 is a perspective view of another type of brickwork course for gas flow control.
Figure 56:
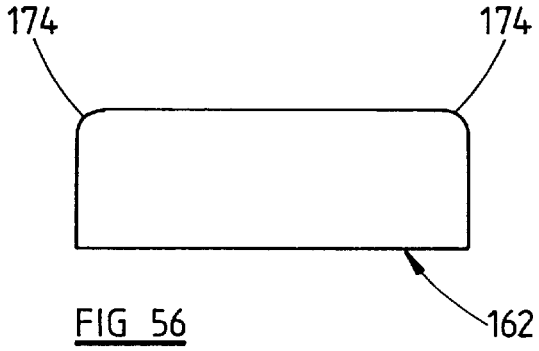
FIG. 56 is a plan view of the outer flue port block.
Figure 55:
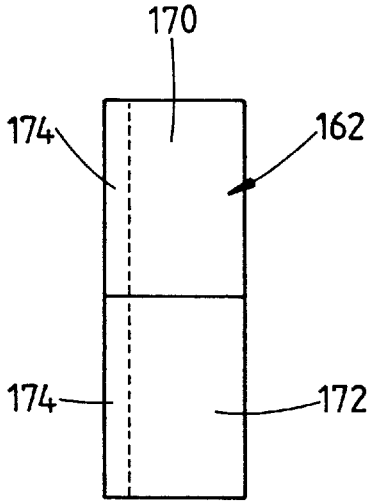
FIG. 55 is an end view of the outer flue port block.
Figure 54:
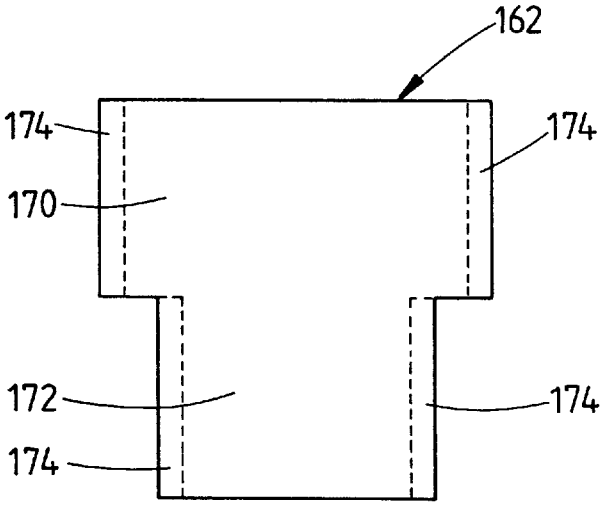
FIG. 54 is a side view of an outer flue port block.

Course E is illustrated in FIG. 15. The outer bricks of this course comprise hammer head bricks 38 and 42 arranged in generally the same way as course C shown in FIG. 13. There are, however, additional bricks located in the cavity regions as will be described below. In particular, course E includes outer flue port blocks 162, inner flue port blocks 164, flue port sleeves 166 and horizontal flue cover tiles 168. The outer flue port block 162 is illustrated in more detail in FIGS. 54 to 56. As can be seen, the block 162 is generally T-shaped having a head 170 and leg 172. Outer vertical corners 174 are rounded so as to be generally complementary to the rounded edges between the head portions and legs of the bricks 38 and 42.

Figure 59:
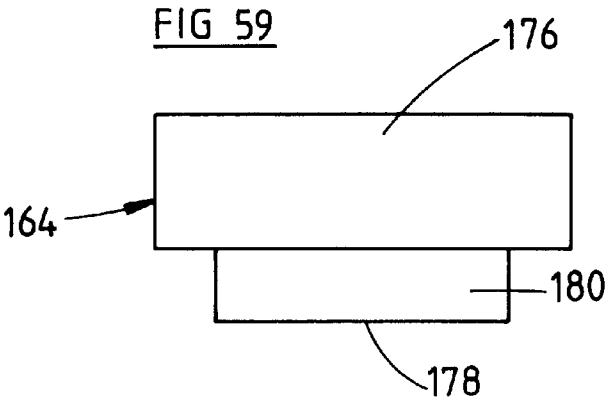
FIG. 59 is a plan view of the inner flue port block.
Figure 57:
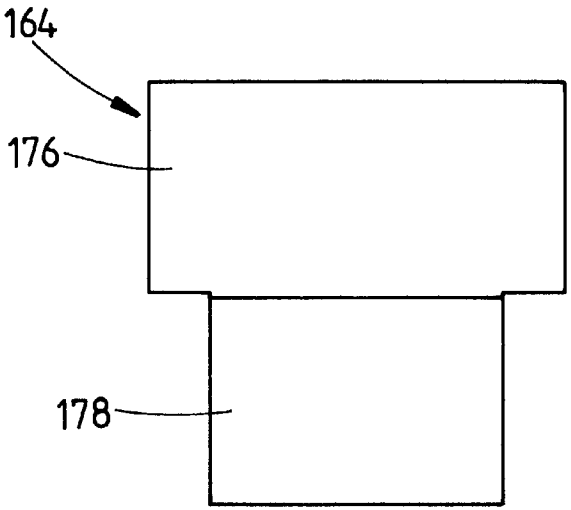
FIG. 57 is a side view of an inner flue port block.
Figure 58:
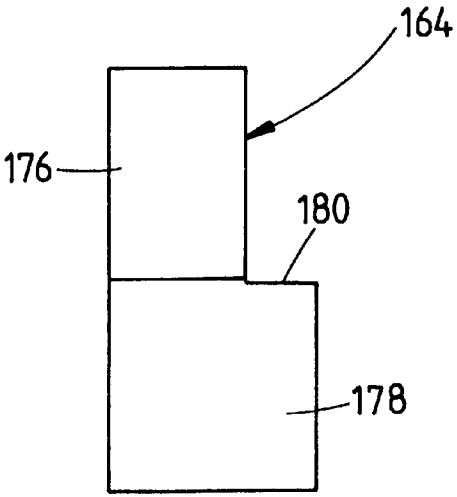
FIG. 58 is an end view of the inner flue port block.

The inner flue port block 164 is illustrated in more detail in FIGS. 57, 58 and 59. It too is T-shaped having a head 176 and leg 178. As best seen in FIG. 58, the leg 78 is wider than the head 176 so as to define a shoulder 180.

Figure 61:
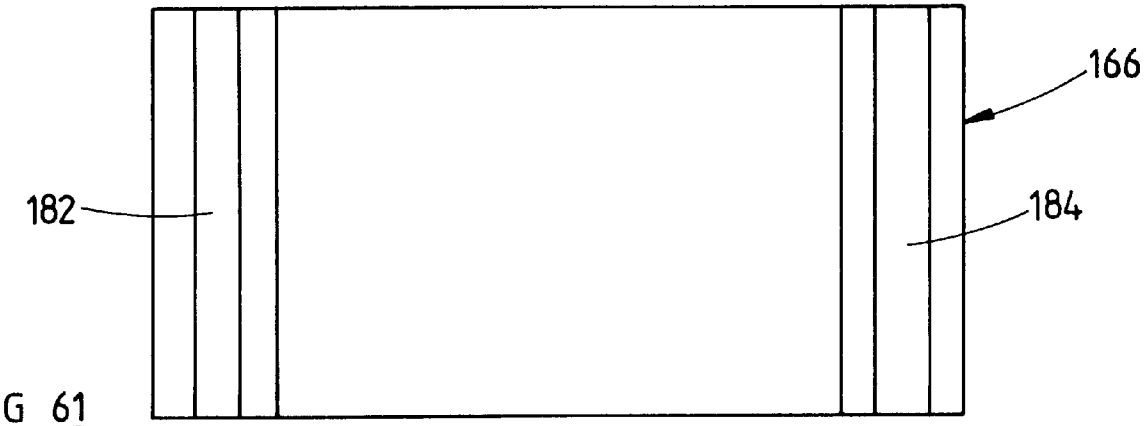
FIG. 61 is a side view of the flue port sleeve.
Figure 62:
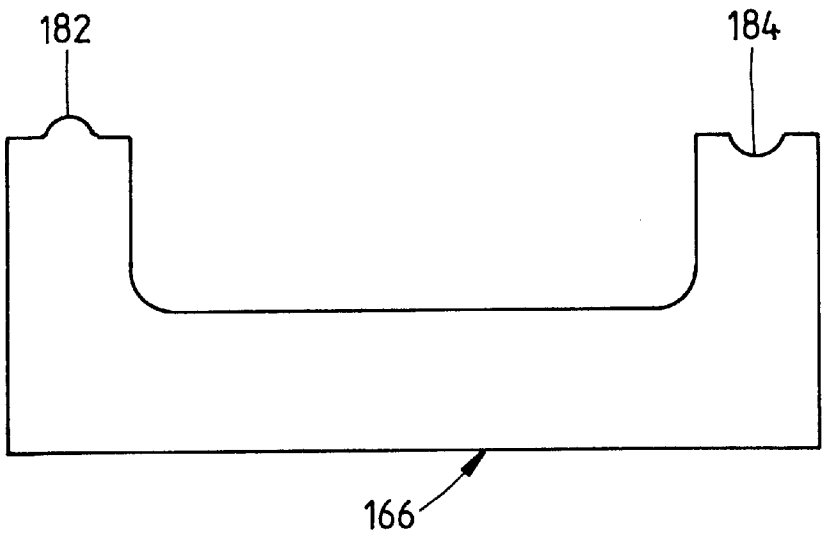
FIG. 62 is a plan view of the flue port sleeve.

As best seen in FIG. 15, two pairs of port blocks 162 and 164 are located between the flue wall bricks 120. The heads 170 and 176 of the blocks engage and are supported by the pairs of bridging bricks 124 in the course below. The legs 172 and 178, however, extend into the cavities 158 between the bridging blocks in course D. A pair of the flue port sleeves 166 are located between the port blocks. The flue port sleeves 166 are illustrated in more detail in FIGS. 60 to 62. It will be seen that these blocks are generally C-shaped and the ends of the legs of the C are provided with a rib 182 and groove 184 respectively. Pairs of the sleeves 166 can be aligned so as to define a generally hollow block including a flue port 186 therein. The rib and groove 182 and 184 of the pair of sleeves interlock, as shown. The sleeves 166 are supported on the shoulders 180 of the inner flue port blocks 164 and the overhang of the bridging brick 124. This bridging brick is not only narrow such that the brick underneath can support two of them, but when two are placed together the pair forms exactly the right shoulder width to support the flue port sleeves 166. It will be seen from FIG. 15 that substantially all of the course E is brick work, the only opening being provided by the flue ports 186.

Figure 51:
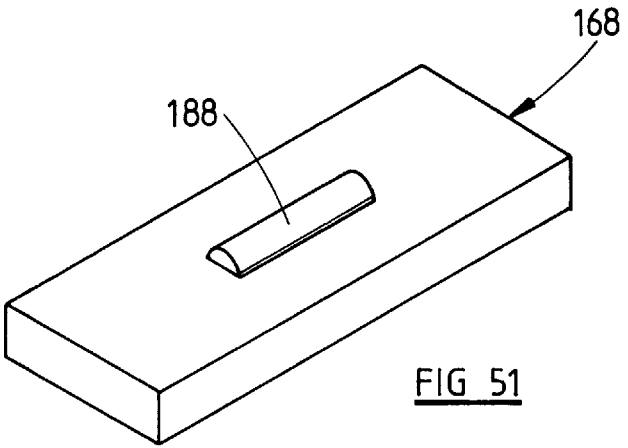
FIG. 51 is an isometric view of a horizontal flue cover tile.
Figure 52:
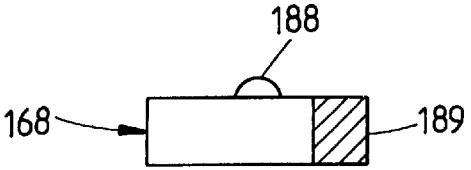
FIG. 52 is an end view of the horizontal flue cover tile.
Figure 53:
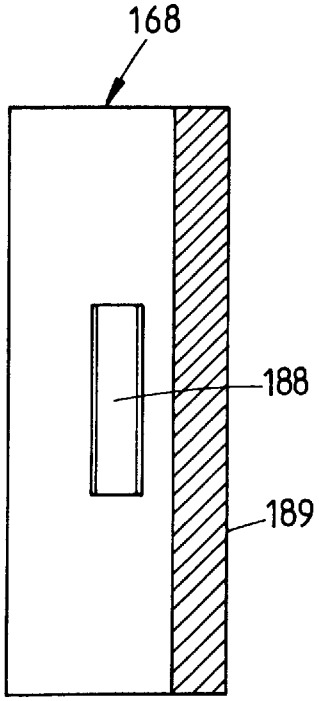
FIG. 53 is a plan view of the horizontal flue cover tile.

Course E also includes horizontal flue cover tiles 168. These are illustrated in more detail in FIGS. 51 to 53. It will be seen that these generally comprise a rectangular tile having a projection 188 located generally in the centre of the lower face of the tile. In the illustrated arrangement, the projections 188 are received within the grooves 72 of the flue wall bricks 120 or brick 46 at the ends of the wall. Course F also includes flue cover tiles 168 on the other side of the course but these are omitted for clarity of illustration. The projections 188 on the opposite side would be received within the grooves 54 of the bricks 38. The tiles 168 on the opposite side are shown in the exploded view of FIG. 7. The inner edges 189 of the tiles 168 can be trimmed to size so as to define between the opposing tiles a wide channel in which the slide bricks 28 can move.

Figure 16:
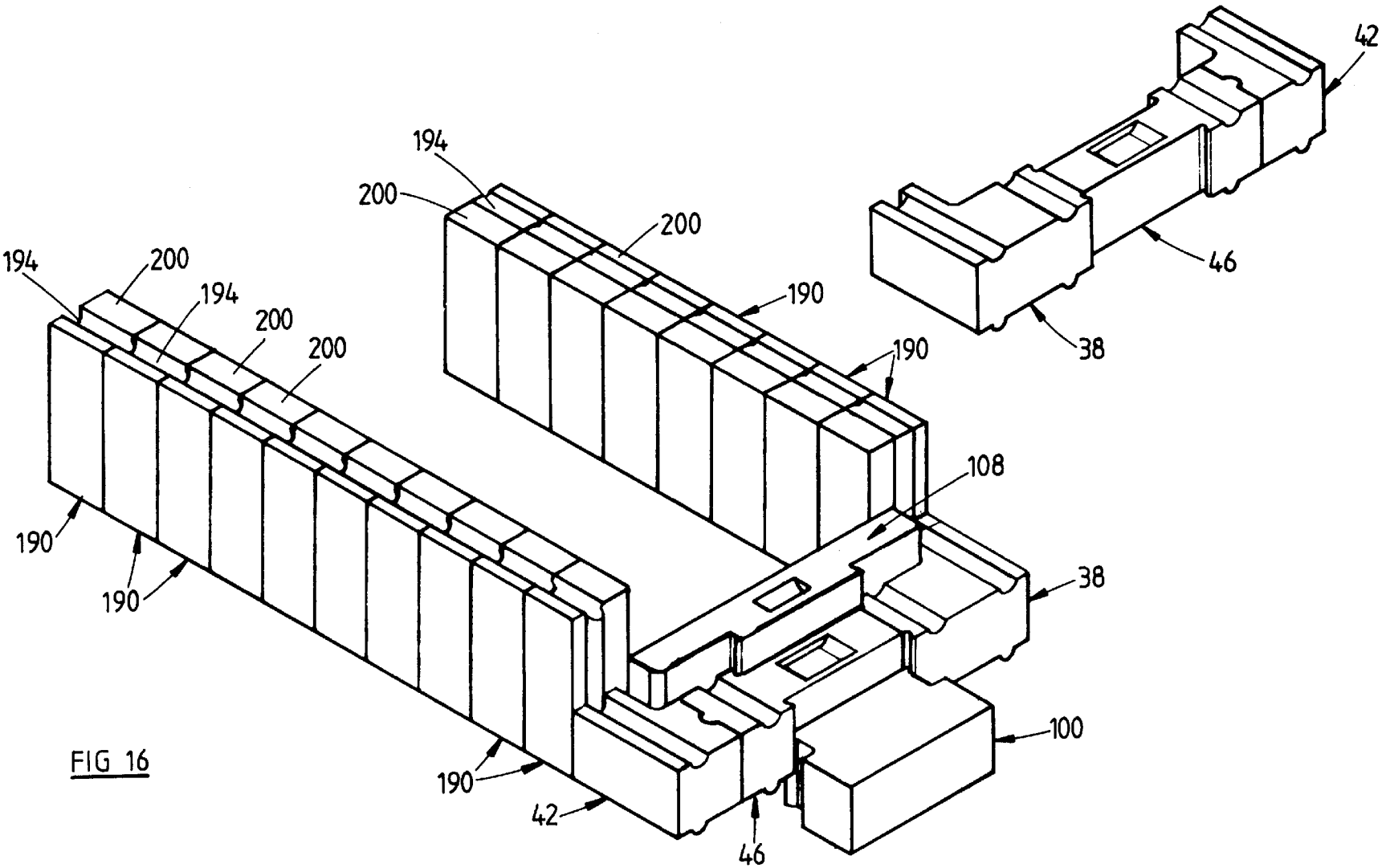
FIG. 16 is a perspective view of the brickwork course at the horizontal flue.
Figure 64:
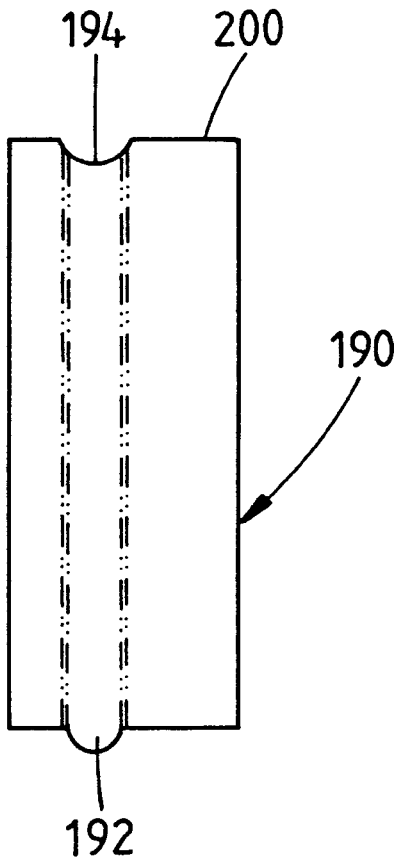
FIG. 64 is a side view of the horizontal flue brick.
Figure 63:
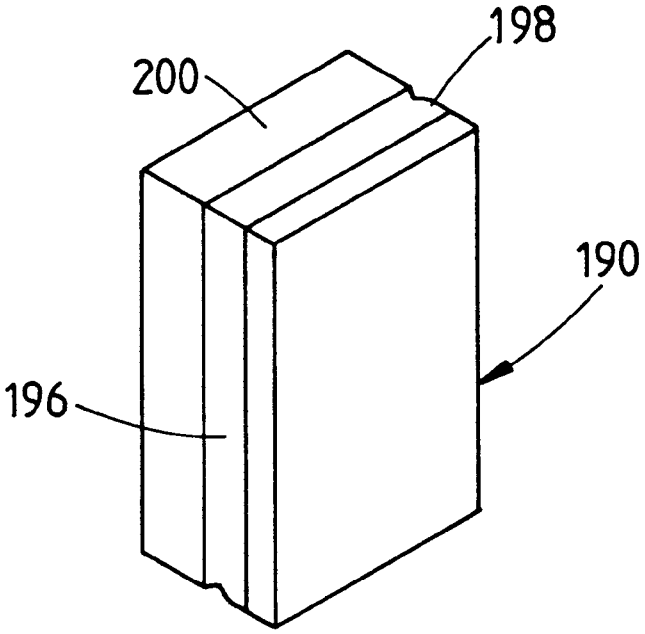
FIG. 63 is an isometric view of a horizontal flue brick.

Course F constitutes the lower wall structure of the horizontal flue 20. The side walls of the horizontal flue 20 are constituted by course F which is shown in FIG. 16. In this arrangement, course F is approximately twice the height of the other courses. It is made up from a plurality of horizontal flue bricks 190 which are shown in more detail in FIGS. 63 and 64. The flue bricks 190 are oblong in shape and are laid in a generally vertical manner as shown in FIG. 16. The bricks 190 include ribs 192 on the lower faces and grooves 194 on their upper faces. The side faces of the bricks 190 are provided with grooves 196 and ribs 198 respectively. The flue bricks 190 are laid such that the ribs 192 are received within the grooves 52 of the bricks 38 and 42 in course E. The ribs and grooves 192 and 194 on the sides of the bricks interlock with one another as shown and the grooves 194 on the top faces of the bricks 190 are aligned for further interlocking with the roof structure of the horizontal flue 20.

Figure 17:
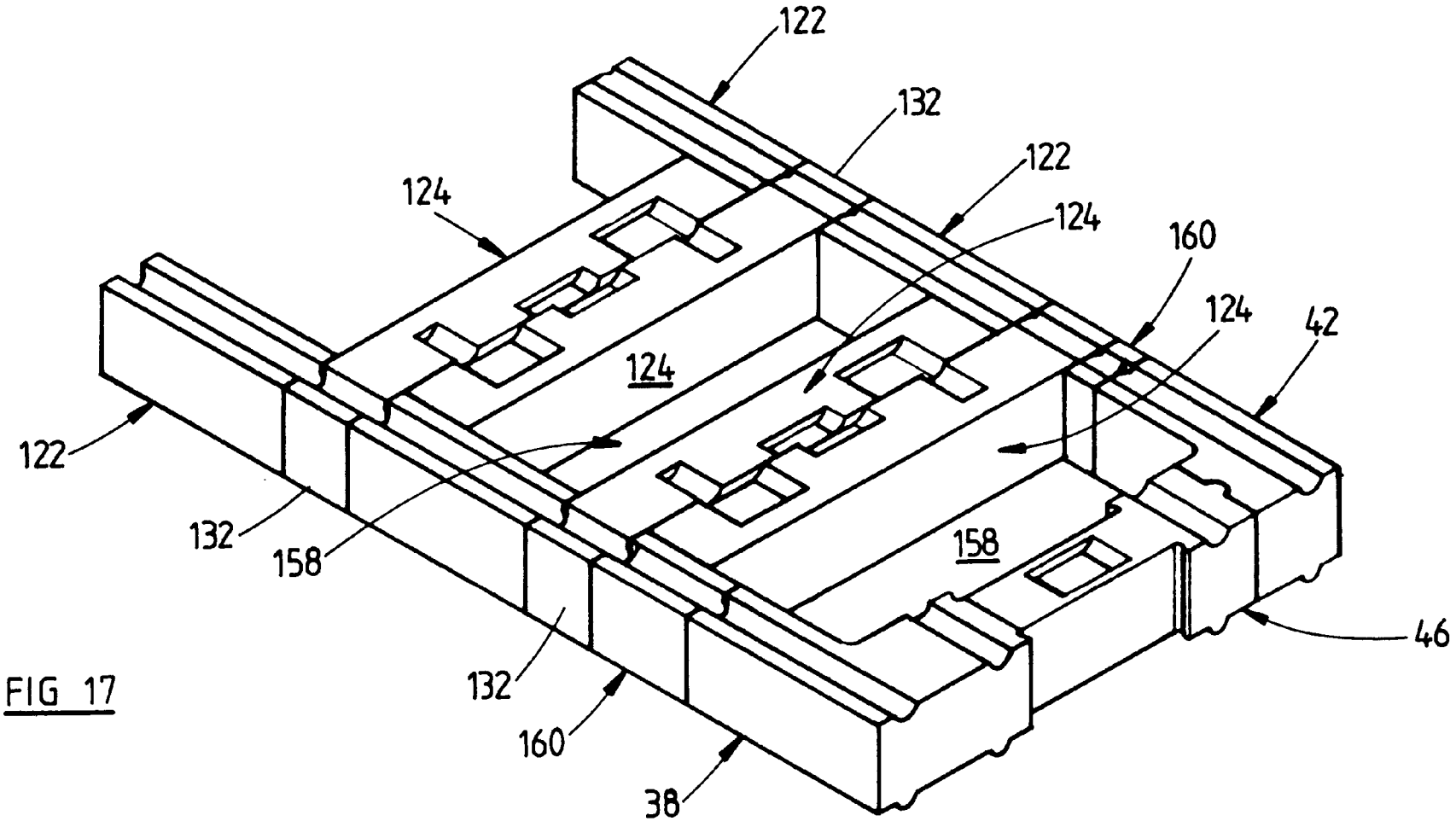
FIGS. 17 and 18 show perspective views of alternating brickwork in the walls through to the oven roof.

FIG. 16 also illustrates the end wall construction of the horizontal flue 20. It can be seen that it is similar to that of course B shown in FIG. 12 and therefore need not be described further. The top wall of the horizontal flue 20 is defined by course G as shown in FIG. 17. Course G is the same as course D shown in FIG. 14 and therefore need not be described in detail. The ribs of the liner bricks 122 are received in the grooves 194 of the horizontal flue bricks 190. Further, the ribs 150 of the bridging bricks 124 are also received in the grooves 194 of the horizontal flue bricks 190. The ends of the bridging bricks 124 which lie inwardly adjacent to the lining bricks 122 are supported on the top faces 200 of the horizontal flue bricks 190.

Figure 18:
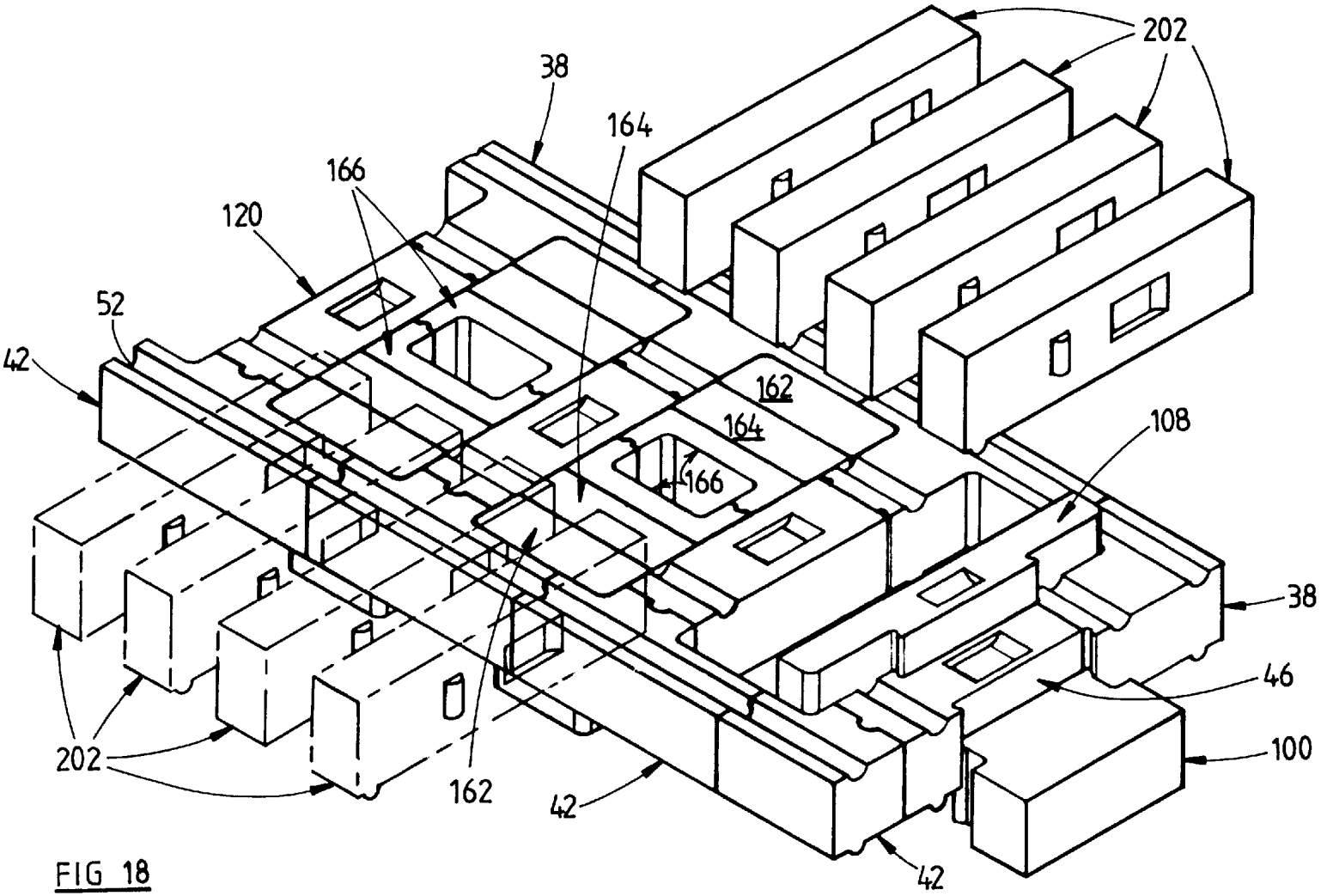
Figure 33:
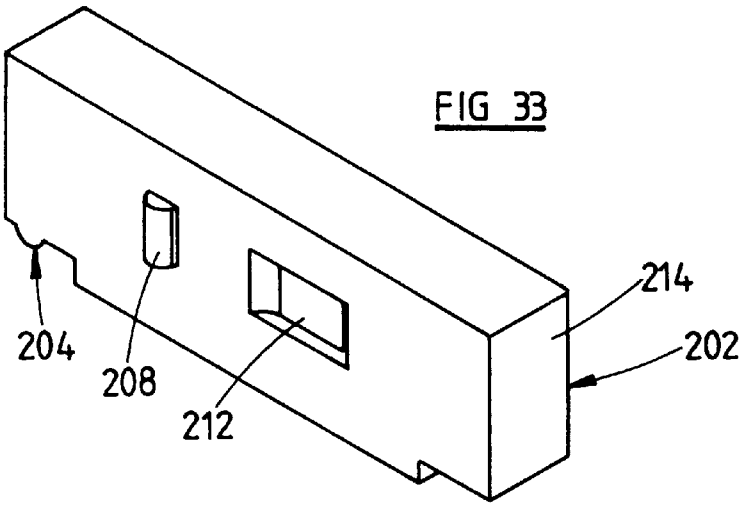
FIG. 33 is an isometric view of an oven roof brick.
Figure 35:
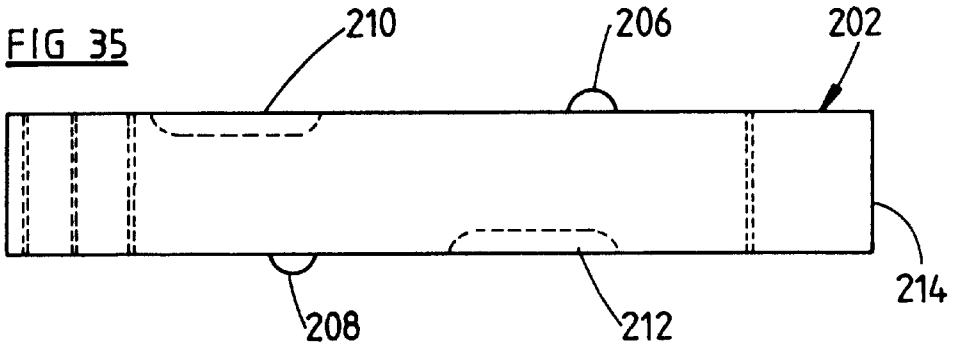
FIG. 35 is a plan view of the oven roof brick.
Figure 34:
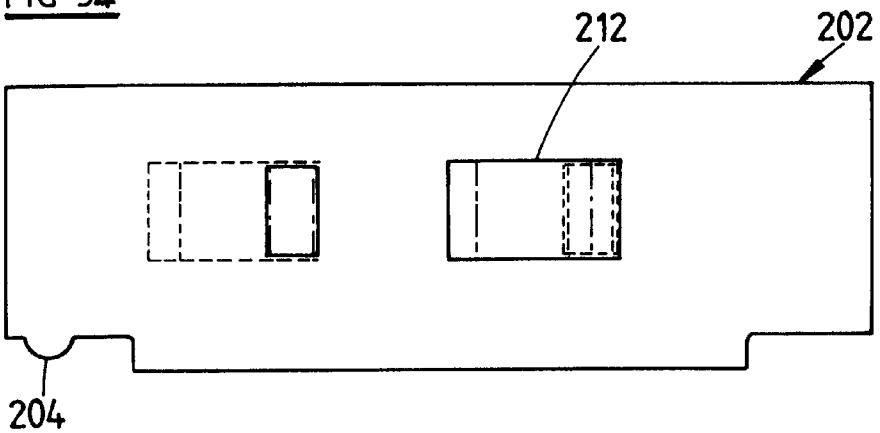
FIG. 34 is a side view of the oven roof brick.

The upper wall structure is completed by course H which is shown in FIG. 18. Most of course H is generally similar to the arrangement of course E shown in FIG. 15 except that the tiles 168 are not required. In this arrangement, the legs of the flue port blocks 162 and 164 will project into and substantially fill the cavities 158 between the bricks 124 and 46. Again, flue port sleeves 166 are provided and these open into the top wall of the horizontal flue 20. As shown in FIG. 3, the upper wall structure of the battery has six alternating courses of courses G and H. The cavities within the sleeves 166 constitute the inspection cavities 22. The uppermost course in the wall which comprises an H course can support oven roof brick tiles 202. The tiles 202 are generally elongate and extend across the gap between adjacent walls. The oven roof brick 202 is illustrated in more detail in FIGS. 33 to 35. It will be seen that it includes a rib 204 adjacent to one edge thereof. The ribs 204 are engagable and interlockable with the grooves 52 in the bricks 38 and 42 of course H. The side faces of the roof bricks 202 include projections 206 and 208 as well as concealed recesses 210 and 212. When the roof bricks 202 are laid side by side, the projections and recesses interlock with one another. The recesses 210 and 212 are much larger in the longitudinal direction than the projections 206 and 208 so as to accommodate changing in the lengths of the bricks 202. The end face 214 of the bricks 202 can be trimmed to length to accommodate tapering of the walls.

The roof structure of the battery can be completed by placing comparatively large blocks of refractory material (not shown) on top of the uppermost course H between the opposed ends of the roof bricks 202 (as originally constructed).

It will be appreciated by those skilled in the art that the horizontal flue 90 is a source of weakness in coke oven walls. In the wall of the invention, the provision of interlocking to courses D and E as well as course G significantly stabilises the horizontal flue bricks 190. The interlocking of the various bricks, particularly the influence of the bridging bricks 124, is important in achieving significantly increased stability in this region.

Because the battery wall construction of the invention is made from comparatively small components, it is possible to effect a repair, partial or full rebuild of a wall without necessarily interfering with the operation of adjacent walls. Where a repair is to be made, the damaged bricks would be removed and the appropriate bricks of the invention would be mortared into place. It is envisaged that the bricks of the invention could be used in batteries where the walls were constructed of other components. Because the interlocking of the various components of the invention can take place with allowances for misalignment, the components of the invention can be used in situations where an oven wall has moved somewhat from its original position. This feature therefore affords considerable flexibility and yet a high level of interlocking is still achievable.

Figure 22:
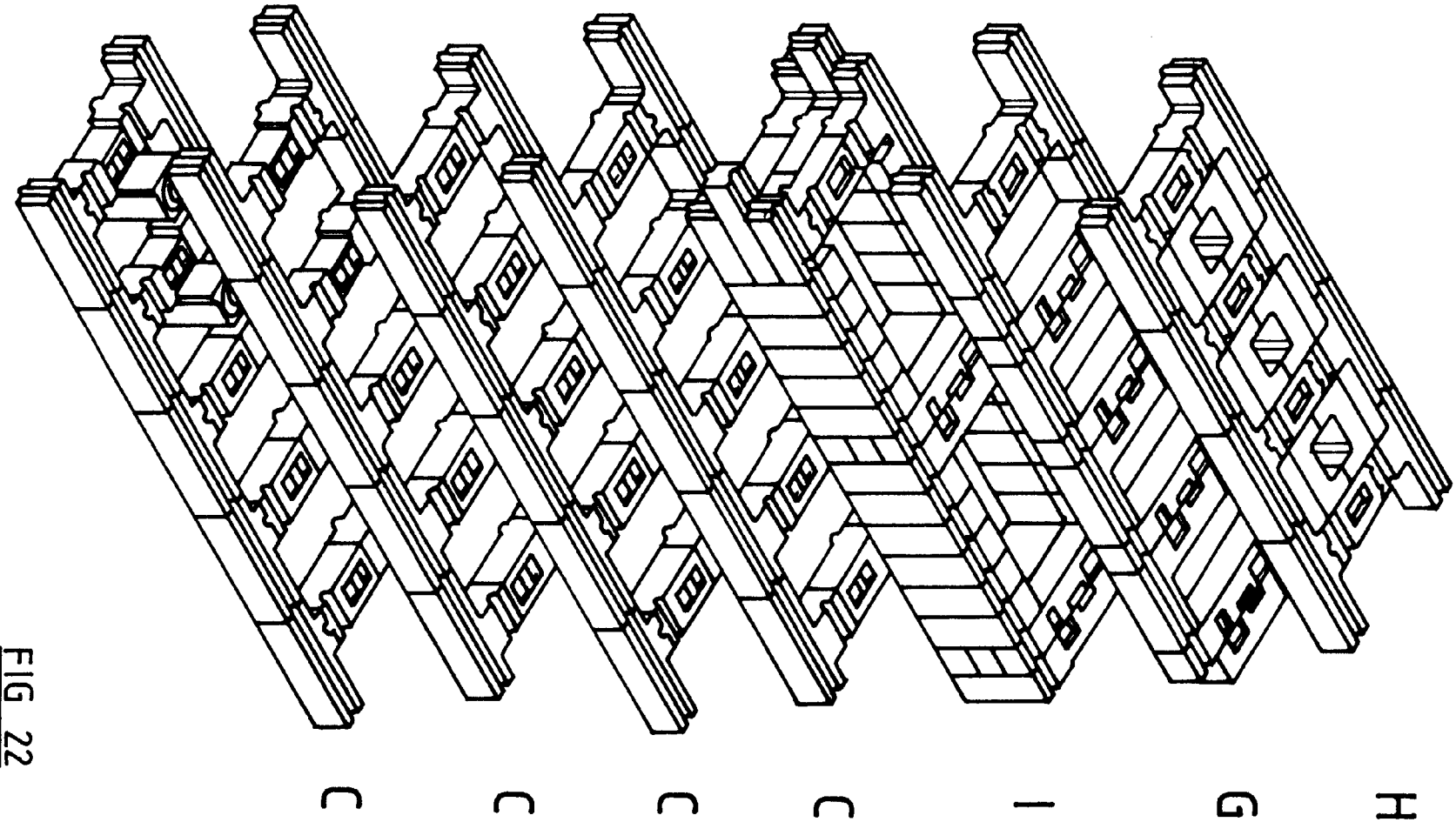
FIG. 22 is a fragmentary exploded view of the twin flue oven wall.
Figure 23:
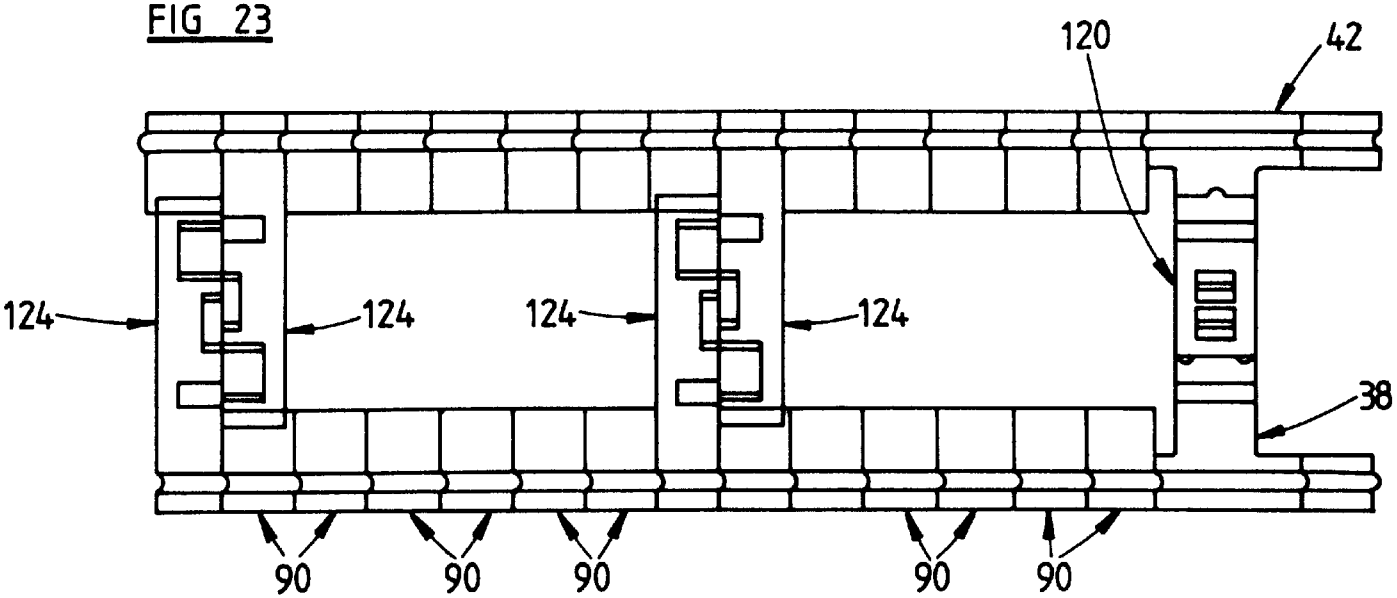
FIG. 23 shows a plan view of the hairpin course of a twin flue oven wall.
Figure 24:
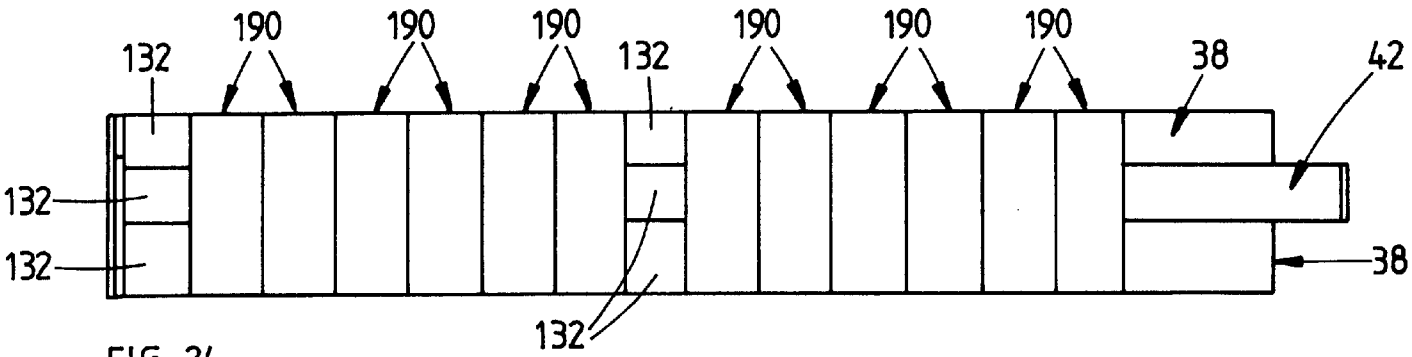
FIG. 24 is a side view of the wall shown in FIG. 23.
Figure 25:
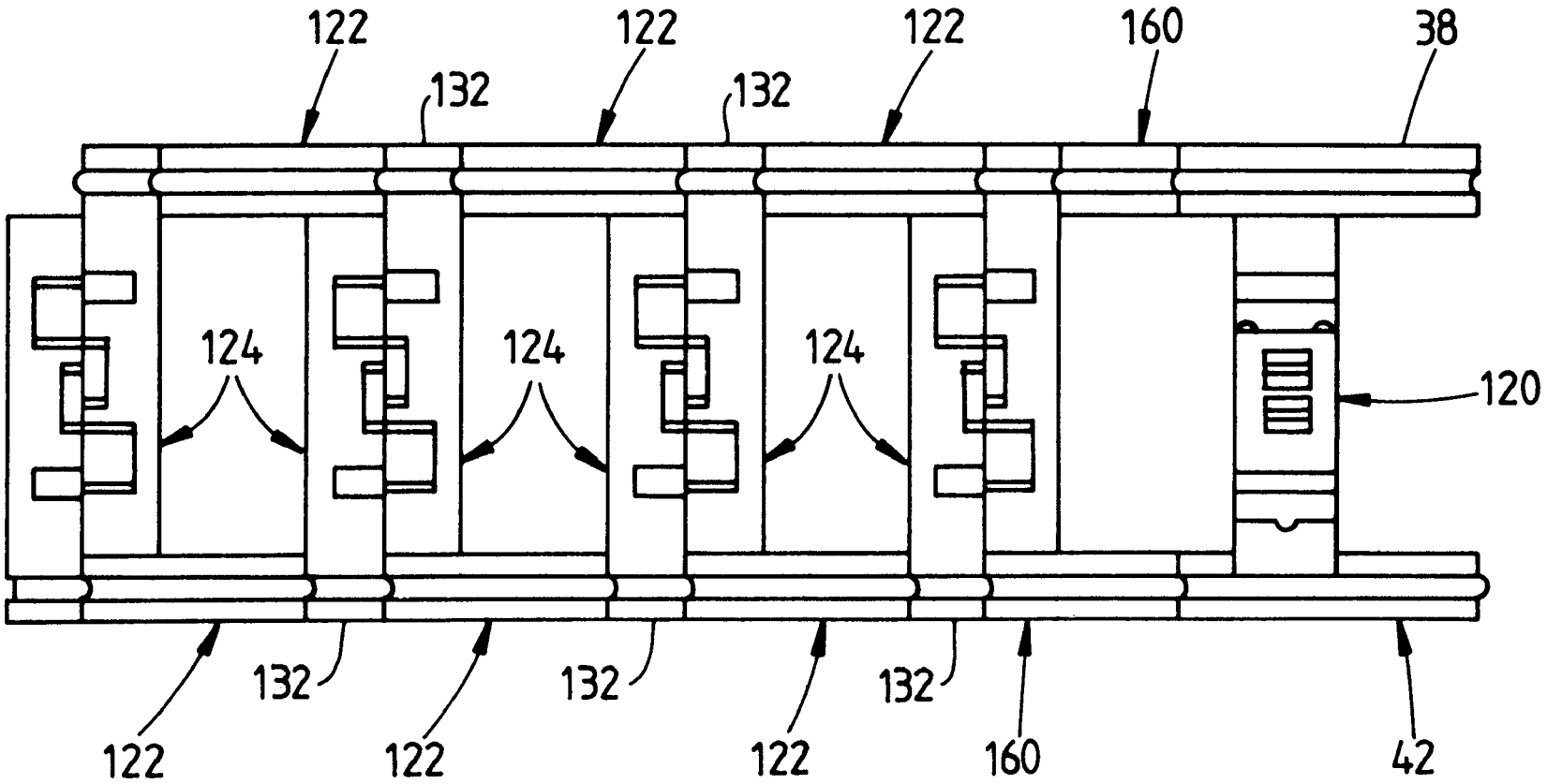
FIG. 25 shows a plan view of another course in the twin flue oven wall above the hairpin.

The principles of the invention can be used to construct a twin flue battery diagrammatically illustrated in FIG. 4. An example of this arrangement is diagrammatically illustrated in FIGS. 21 to 25. FIG. 22 shows an exploded view and it will be seen that there are four courses which are the same as course C of FIG. 13. Above the uppermost course C is a course I which will be described below. Above course I are courses G and H which are essentially the same as those shown in FIGS. 17 and 18. The course I is, generally speaking, made up from horizontal flue wall bricks 190, bridging bricks 124, large and small hammer head bricks 38 and 42, and flue wall bricks 120. Generally speaking, a predetermined number of say five of the horizontal flue wall bricks 190 are laid on course C in a similar manner to that illustrated in FIG. 16. Pairs of bridging bricks are then interposed between the groups of bricks 190 to define the transversely extending baffles 30. The baffles 30 are made from three pairs of the bridging bricks 124 which are vertically stacked. The end faces 132 of the bricks 124 define in part the wall faces 40 and 44. The inner end faces 134 of the bricks 124 lay adjacent to the inner faces of the horizontal flue bricks 190 and are cut to length to suit oven taper. The bricks 124 are, however, located above the flue wall bricks 120 of the course C immediately beneath course I. Interlocking occurs between the various bricks in the same way as described with reference to FIGS. 8 to 15. The top of the twin flue arrangement is constituted by courses G and H, as indicated in FIG. 22. These are the same as courses G and H shown in FIGS. 17 and 18 and therefore need not be described in detail. As seen in FIG. 4, a number of courses G and H can be alternated so as to complete the roof structure with inspection cavities 22.

Other advantages of embodiments of the invention are:

i) Dovetail grooves in bricks 46 and 86 enable positive engagement of the burner blocks 86. The dovetail projections 92 formed in the burner blocks decrease in width from pusher side 10 to coke side 12 and burner blocks are selected from preferably eight incremental sizes accordingly.

ii) Only one brick, namely the flue port sleeve 166, weighs in excess of 20 kg. This represents a significant reduction in the weight of the bricks when compared to the prior art and improves workers occupational health and safety.

iii) Reduced number of brick shapes suitable for either pusher side or coke side results in reduced inventory value.

iv) Design of bricks is independent of generic product types or qualities.

v) Original combustion thermodynamics of repaired oven walls and ovens can be maintained.

vi) Bricks can be readily integrated into existing oven walls during partial repairs.

vii) Embodiments enable construction of walls into existing ovens with significant expansion without loss of any of the abovementioned benefits.

viii) Reduced number of construction joints leading to improved gas tightness and lower stack emissions.

ix) Embodiments of the invention lend themselves to making patch type repairs in existing wall sections or full rebuilds.

x) Better interlocking of horizontal flue components when compared to prior art arrangements leading to better wall stability.

Many modifications will be apparent to those skilled in the art without departing from the spirit and scope of the invention.

What is claimed is:

1. A coke oven wall (4) which is constructed from a plurality of bricks (38,42,46,120) laid so as to define first and second wall faces (40,44), and a plurality of flue cavities (14) extending therein the wall including a plurality of alternating first and second courses (C) and wherein the first and second courses are defined by first, second and third bricks (38,42,120) and wherein:

each first brick includes a first body portion (48) and an inwardly projecting first leg which has a first inner end face (50);

each second brick includes a second body portion (64) and an inwardly projecting second leg (66) which has a second end face, the length of the second leg being shorter than the length of the first leg; and each third brick comprises a flue wall brick (46,120) having a third body portion which has third and fourth end faces;

and wherein each first course includes:

a plurality of the first bricks laid side by side with the body portions thereof defining part of the first wall face;

a plurality of the second bricks laid side by side with body portions thereof defining part of the second wall face; and a plurality of the third bricks; and wherein each of the third body portions is interposed between opposed pairs of first and second legs with its third and fourth end faces abutting the first and second end faces respectively whereby the first and second body portions define part of the first and second wall faces respectively; and wherein each second course is the same as the first course except that the positions of the first and second bricks are reversed so that body portions of the first and second bricks in the second course define parts of the second and first wall faces respectively.

2. A coke oven wall as claimed in claim 1 wherein each third end face of the flue wall brick includes a first interlocking formation (76) and each second end face of the second leg includes a second, complementary formation (70).

3. A coke oven wall as claimed in claim 2 wherein the fourth end face (82) of the flue wall brick (46,120) is shaped so that it can be trimmed to length so as to abut the first end face of the first leg whereby the walls taper depending on the amount trimmed from the fourth end faces of the flue bricks.

4. A coke oven wall as claimed in claim 3 wherein the first and second bricks include upper and lower formations (52,56) on upper and lower faces thereof whereby successive courses of bricks interlock with one another.

5. A coke oven wall as claimed in claim 4 wherein the upper and lower formations are shaped so that they can be used in an existing battery wall.

6. A coke oven wall as claimed in claim 5 wherein the first and second body portions have the same length and the first leg is offset by a predetermined amount relative to the length of the first body portion and the second leg is offset by the same predetermined amount relative to the length of the second body portion but in the opposite direction, the arrangement being such that the first and second faces of the wall have alternate courses of first and second bricks in a bond pattern.

7. A coke oven wall as claimed in claim 6 wherein the flue brick includes a third interlocking formation (78) on its upper face and a fourth generally complementary formation (80) on its lower face, said third and fourth formation having a relatively loose fit when said flue bricks are laid on top of each other to thereby accommodate said trimming.

8. A coke oven wall as claimed in claim 7 wherein the third and fourth formations do not extend to the edges of the upper and lower faces.

9. A coke oven wall as claimed in claim 1 wherein said oven wall includes burners (16,18) in the flue cavities, said burners comprising a stack of burner bricks (86), said burner bricks including interlocking formations which interlock with complementary formations on the bricks which define the flue cavities whereby the burners are supported or restrained in the cavities.

10. A coke oven wall as claimed in claim 1 wherein the wall includes a horizontal flue or hairpin (20) therein and wherein the course or courses of bricks immediately beneath the horizontal flue or hairpin include flue ports (186) which are supported by bridging bricks (124) which extend between faces of the walls above the flue cavities therein.

11. A coke oven wall as claimed in claim 10 wherein the flue ports are made from a pair of similar interlocking shells (166).

12. A coke oven wall as claimed in claim 11 wherein blocking bricks (162) are located laterally of the flue ports.

13. A coke oven wall as claimed in claim 12 wherein the horizontal flue or hairpin includes cover tiles (168) which are laid over said blocking bricks so as to minimise flow of flue gases between gaps therein.

14. A coke oven wall (4) as claimed in claim 1 including at least one third course which includes a plurality of bridging bricks (124) each having an outer face, which in use defines part of the first or second wall face, said bridging brick including an upper face and a lower face, there being provided on the upper face a first interlocking formation (144,142) which does not extend to the side edges of the upper face of the bridging brick, the lower face of the bridging brick including a second interlocking formation (146,148) which does not extend to the side edges of the lower face of the bridging brick, the arrangement being such that when a plurality of said bridging bricks are laid the interlocking formations interlock and wherein one of the first and second formations is of greater width (as measured in the direction towards said outer face) whereby the outer faces of the bridging bricks can define parts of the first and second wall faces which taper and wherein the wider formation accommodates different positions of the narrower formation.

15. A coke oven wall as claimed in claim 1 wherein the first and second bricks have outer faces which define parts of said first and second wall faces (40,44) of the wall and wherein the first brick has upper and lower faces which include first and second formations (52,56) which extend to the side edges of said upper and lower faces, said formations being located at a first predetermined distance from one face (40,44) of the wall of which said first brick forms part and wherein the third brick has upper and lower faces which include third and fourth formations (72,74) which extend to the side edges of the upper and lower faces of the third brick, the arrangement being such that, in the first course of said wall, the third and fourth formations are located at the first predetermined distance from the second wall face (40,44) of the wall of which the second brick forms part.

16. A coke oven wall as claimed in claim 15 wherein the second course of said wall, the first and fourth formations (52,74) interlock and the second and third formations (56, 72) interlock.

17. A coke oven wall as claimed in claim 15 wherein the upper and lower faces of the third brick includes fifth and sixth formations (78,80) which do not extend to the side edges of the upper and lower faces of the third brick.

18. A coke oven wall as claimed in claim 17 wherein one of said fifth and sixth formations comprises a recess (78) and the other a projection (80) and wherein said recess is longer in the direction of said first predetermined distance than said projection (80) whereby an end of the third brick can be trimmed for tapering of said walls without affecting interlocking of said first, second, third and fourth formations.

19. A coke oven wall as claimed in claim 18 wherein the lengths of said body first and second body portions are the same as measured along a course of said wall.

20. A coke oven wall as claimed in claim 19 wherein the leg (50) of the first brick is offset by a second predetermined distance relative to the centre of its body portion (48) and the leg (66) of the second brick is offset by said second predetermined distance relative to the centre of its body portion (64) but in the opposite sense to the leg of the first brick whereby the body portions of the first and second bricks form a bond pattern in successive first and second courses of the wall.

21. An oven wall as claimed in claim 1 wherein each first, second and third brick weighs less than 20 kg.

* * * * *